US010124609B2

(12) United States Patent
Kikuchi et al.

(10) Patent No.: US 10,124,609 B2
(45) Date of Patent: Nov. 13, 2018

(54) CUTTING APPARATUS AND PRINTING APPARATUS

(71) Applicant: CANON KABUSHIKI KAISHA, Tokyo (JP)

(72) Inventors: Tetsuo Kikuchi, Ayase (JP); Naoki Wakayama, Kawasaki (JP); Shuichi Masuda, Yokohama (JP); Masakazu Nagashima, Yokohama (JP); Daiki Anayama, Yokohama (JP); Takakazu Ohashi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/272,708

(22) Filed: Sep. 22, 2016

(65) Prior Publication Data

US 2017/0087889 A1 Mar. 30, 2017

(30) Foreign Application Priority Data

Sep. 28, 2015 (JP) ..... 2015-189989

(51) Int. Cl.

| | |
|---|---|
| ***B41J 11/70*** | (2006.01) |
| ***B41J 2/01*** | (2006.01) |
| ***B26D 1/08*** | (2006.01) |
| ***B26D 1/18*** | (2006.01) |
| ***B26D 1/24*** | (2006.01) |
| ***B26D 5/32*** | (2006.01) |

(52) U.S. Cl.

CPC ..... *B41J 11/70* (2013.01); *B26D 1/08* (2013.01); *B26D 1/185* (2013.01); *B26D 1/245* (2013.01); *B26D 5/32* (2013.01); *B41J 2/01* (2013.01)

(58) Field of Classification Search

CPC ..... B41J 11/706; B41J 11/70; B41J 11/663; B26D 1/245; B26D 5/02; Y10T 83/8822

See application file for complete search history.

(56) References Cited

U.S. PATENT DOCUMENTS 5,881,623 A * 3/1999 Otani ..... B26D 1/245 83/455
6,151,037 A * 11/2000 Kaufman ..... B41J 3/4075 347/104
6,554,511 B2 * 4/2003 Kwasny ..... B26D 5/02 234/42

(Continued)

FOREIGN PATENT DOCUMENTS

JP 2000-317884 A 11/2000
JP 2003266832 A 9/2003

(Continued)

OTHER PUBLICATIONS

Machine Translation of Sep. 20, 2018 IDS—NPL #1—https://dossier2.j-platpat.inpit.go.jp/tfw/all/odsefwi/ODSEFWI_GM401_documentDisplay.action Sep. 25, 2018.*

(Continued)

*Primary Examiner* — John P Zimmermann
(74) *Attorney, Agent, or Firm* — Fitzpatrick, Cella, Harper & Scinto

(57) ABSTRACT

In order to reliably cut a sheet even when the width of the sheet is changed while shortening cutting time, the position of an end portion of the sheet is sensed and a cutting range is set according to the sensed position of the end portion.

21 Claims, 30 Drawing Sheets

(56) References Cited

U.S. PATENT DOCUMENTS

| | | | | |
|---|---|---|---|---|
| 7,534,061 | B2 * | 5/2009 | Kaneko | B26D 5/16 400/621 |
| 8,817,329 | B2 * | 8/2014 | Satoh | G01J 3/462 358/1.9 |
| 2005/0186010 | A1 * | 8/2005 | Shibata | B26D 7/015 400/621 |
| 2009/0226236 | A1 * | 9/2009 | Yamashita | B26D 1/185 400/621 |
| 2012/0062678 | A1 * | 3/2012 | Tsuji | B26D 1/205 347/104 |
| 2014/0293376 | A1 * | 10/2014 | Tokura | H04N 1/00795 358/498 |
| 2016/0067874 | A1 | 3/2016 | Maruyama et al. | |
| 2016/0067987 | A1 | 3/2016 | Ohashi et al. | |
| 2016/0067988 | A1 | 3/2016 | Anayama et al. | |

FOREIGN PATENT DOCUMENTS

| | | | |
|---|---|---|---|
| JP | 2006043835 | A | 2/2006 |
| JP | 2012066455 | A | 4/2012 |

OTHER PUBLICATIONS

U.S. Appl. No. 15/272,718, filed Sep. 22, 2016.
Japanese Office Action issued in corresponding Japanese Application No. 2015189989 dated Aug. 28, 2018.

* cited by examiner

| FIG.27A |
| --- |
| FIG.27B |

CUTTING APPARATUS AND PRINTING APPARATUS

BACKGROUND OF THE INVENTION

Field of the Invention

The present invention relates to a cutting apparatus that can cut a sheet and a printing apparatus including the cutting apparatus.

Description of the Related Art

Japanese Patent Laid-Open No. 2000-317884 discloses a recording apparatus that sets a plurality of cutting ranges of a sheet to be cut by a cutting apparatus and switches the cutting ranges according to the width of a sheet in order to shorten cutting time.

However, since the cutting apparatus disclosed in Japanese Patent Laid-Open No. 2000-317884 selects the cutting range from the plurality of cutting ranges, which are fixedly set in advance, according to the width of a sheet, there is a concern that cutting failure may occur when the width of the sheet is changed due to unexpected factors. Examples of factors, which cause the width of the sheet to change, include the expansion of a sheet, such as paper, which is caused by changes in temperature and humidity, the skew of a sheet during the conveyance of the sheet, and the winding of an end portion of a sheet. When a sheet of which the width has been changed as described above is cut in a preset cutting range, there is a concern that cutting failure in which an uncut portion of the sheet remains may occur.

SUMMARY OF THE INVENTION

The present invention provides a cutting apparatus that can reliably cut a sheet even when the width of the sheet is changed while shortening cutting time, and a printing apparatus.

In the first aspect of the present invention, there is provided a cutting apparatus comprising: a cutter unit configured to cut a sheet; a sensing unit configured to sense a position of an end portion of the sheet; and a moving unit configured to move the cutter unit in a range corresponding to the position of the end portion sensed by the sensing unit.

In the second aspect of the present invention, there is provided a cutting apparatus comprising: a cutter unit configured to cut a sheet conveyed in a conveying direction; and a moving unit configured to move the cutter unit in a direction crossing the conveying direction, wherein the moving unit allows the cutter unit to reciprocate between a stand-by position and a reverse position, and the cutter unit includes a cutting portion that cuts the sheet while moving to the reverse position from the stand-by position, and a push-out portion that pushes out a cut piece of the sheet in the conveying direction.

In the third aspect of the present invention, there is provided a printing apparatus comprising: a cutting apparatus comprising a cutter unit configured to cut a sheet, a sensing unit configured to sense a position of an end portion of the sheet, and a moving unit configured to move the cutter unit in a range corresponding to the position of the end portion sensed by the sensing unit; and a printing unit configured to print an image on the sheet.

According to the present invention, since the position of an end portion of a sheet is detected and a cutting range is set according to the detected position of the end portion, a sheet can be reliably cut even when the width of the sheet is changed while cutting time is shortened.

Further features of the present invention will become apparent from the following description of exemplary embodiments (with reference to the attached drawings).

DESCRIPTION OF THE EMBODIMENTS

Embodiments of the invention will be described below with reference to the drawings.

First Embodiment

Figure 1:
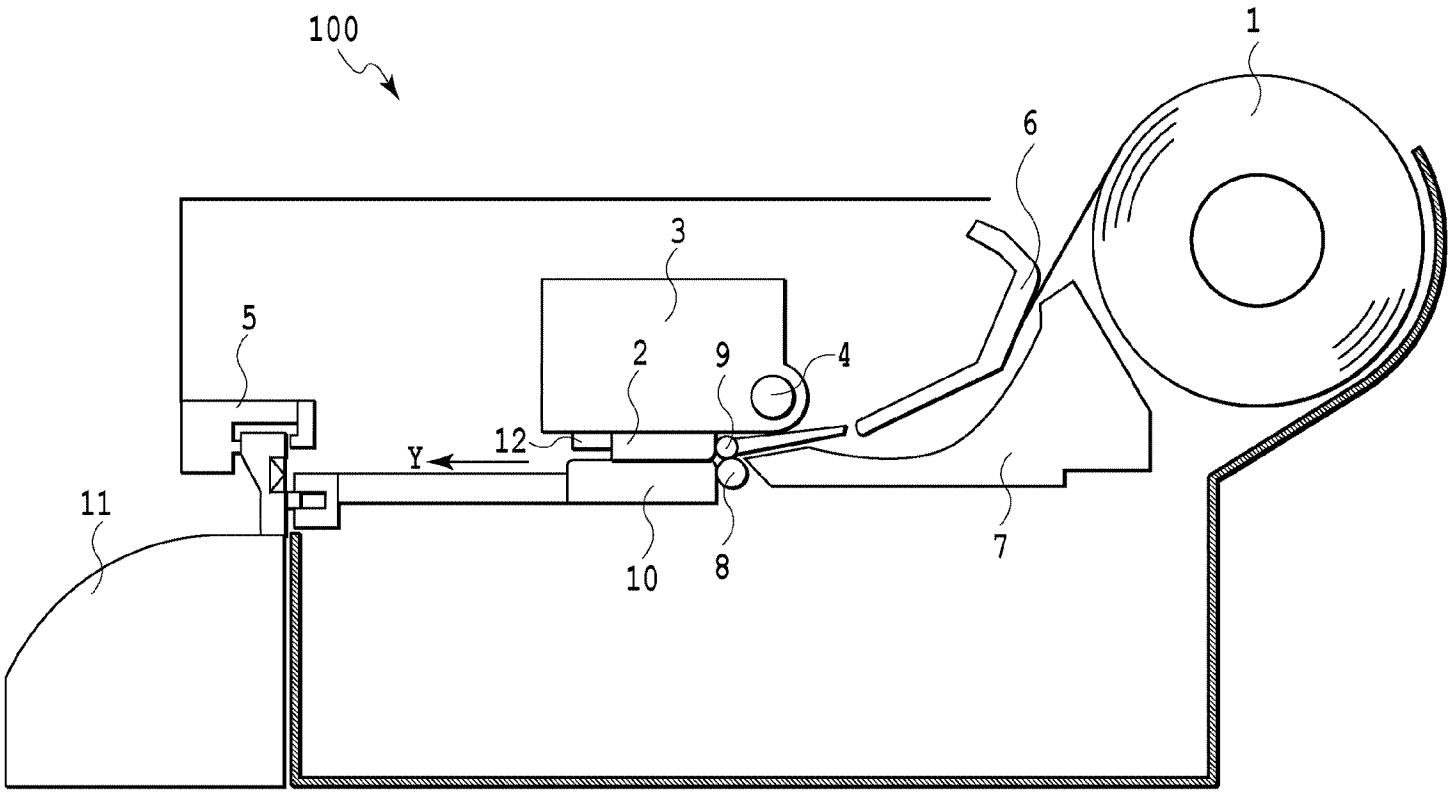
FIG. 1 is a diagram illustrating the schematic structure of a printing apparatus according to the invention.

FIG. 1 is a sectional view of an ink jet printing apparatus 100 according to an embodiment of the invention. A continuous sheet 1, which is wound into a roll, is held in the printing apparatus 100, and the sheet 1 is sent through a conveying path between an upper guide 6 and a lower guide 7. The sheet 1 is held at a nip portion between a conveying roller 8 and a pinch roller 9, is conveyed in a conveying direction, which is indicated by an arrow Y, and is sent onto a platen 10 disposed at a printing position that faces a printing head 2. Images are printed on the sheet 1, which is conveyed to the printing position, with ink ejected from the printing head 2. The printing head 2, a carriage 3 for printing on which the printing head 2 is mounted, and the platen 10 that is disposed so as to face the printing head 2 form an image printing unit. A carriage shaft 4 and a guide rail (not illustrated) are disposed in the printing apparatus 100 so as to be parallel to each other, and the carriage 3 is guided so as to be capable of reciprocating along the carriage shaft 4 and the guide rail in a direction crossing the conveying direction Y (orthogonal to the conveying direction Y in the case of this embodiment). A sheet end sensor 12, which is provided on the carriage 3, moves together with the carriage 3 and detects the position of an end portion of the sheet 1. After the image printing unit prints an image corresponding to one line, with the forward movement or reverse movement of the carriage 3, the image printing unit conveys the sheet 1 by a predetermined distance in the conveying direction and then prints an image corresponding to the next line, with the movement of the carriage 3. A printed portion (a portion having been subjected to printing) of the sheet 1 on which images have been printed is conveyed toward a sheet discharge guide 11.

Images can be sequentially printed on the sheet 1 by the repetition of this operation. A portion of the sheet 1 on which predetermined images have been printed is cut at a cutting position of a cutting apparatus 5. The sheet, which has been cut, (cut sheet) is discharged to the outside of the printing apparatus 100 from the sheet discharge guide 11. The printing apparatus 100 is not limited to only a serial scan system described in this embodiment, and may be a so-called full line system and the like and may be a printing system other than an ink jet system.

Figure 2:
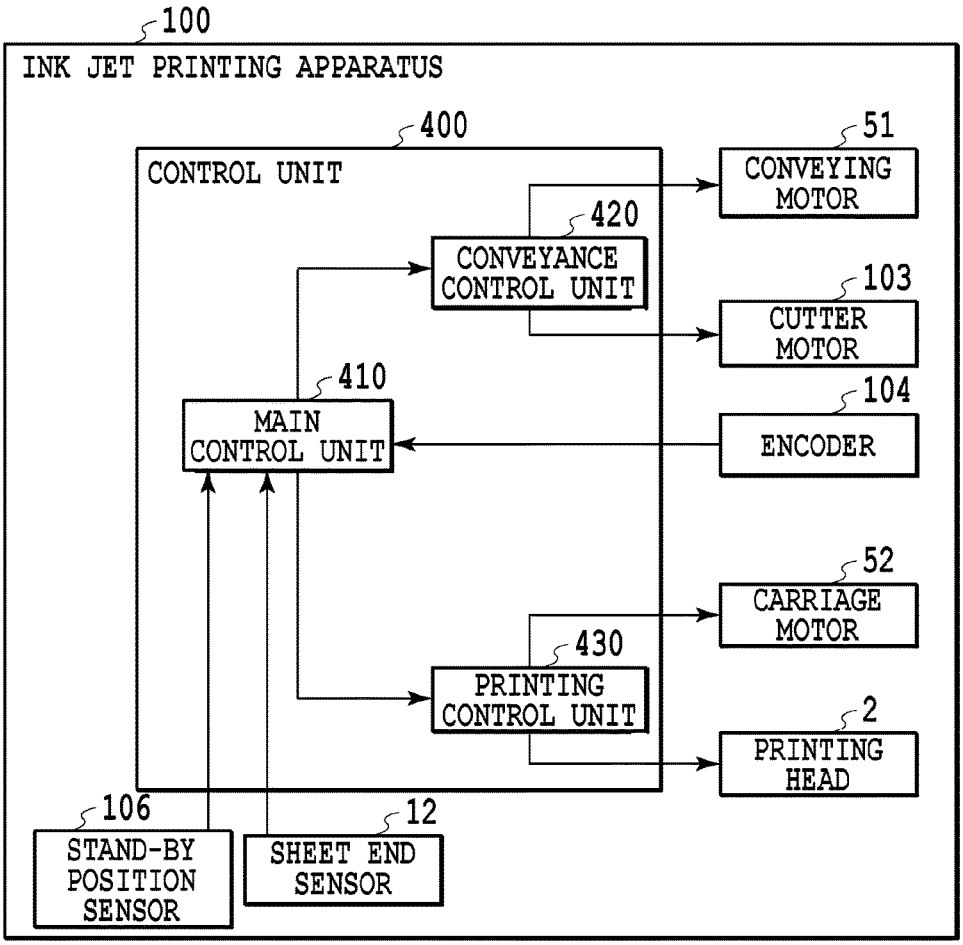
FIG. 2 is a block diagram of a control system of the printing apparatus of FIG. 1.

FIG. 2 is a block diagram illustrating the configuration of a control system of the printing apparatus 100.

A control unit 400 provided in the printing apparatus 100 controls a conveying motor 51, a cutter motor 103, a carriage motor 52, and the printing head 2 on the basis of signals sent from an encoder 104 of the cutter motor 103, the sheet end sensor 12, and a stand-by position sensor 106. The control unit 400 is provided with a CPU, a ROM, a RAM, and a motor driver (not illustrated), and the like, and includes a main control unit 410, a conveyance control unit 420, and a printing control unit 430. The main control unit 410 gives instructions to the conveyance control unit 420 and the printing control unit 430. Under the control of the main control unit 410, the conveyance control unit 420 rotates the conveying roller 8 by the conveying motor 51 to convey the sheet 1 and operates the cutting apparatus 5 by the cutter motor 103 to cut the sheet 1. The printing control unit 430 performs printing of images on the sheet 1 by the movement of the carriage 3, which is performed by the carriage motor 52, and an operation for ejecting ink from the printing head 2.

(Schematic Structure of Cutting Apparatus)

Figure 3:
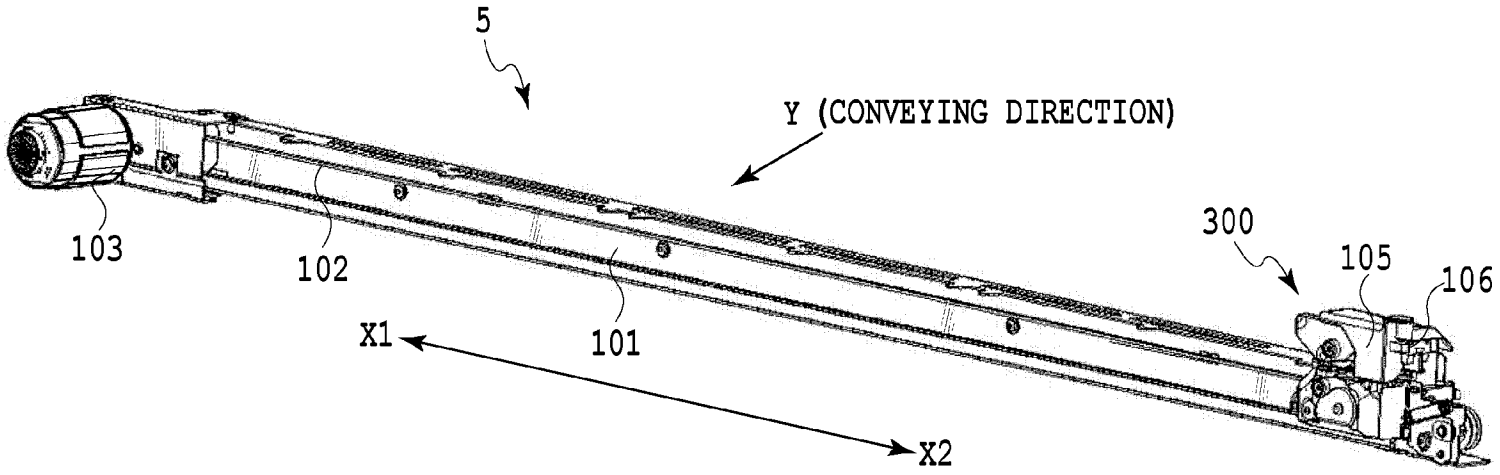
FIG. 3 is a perspective view of a cutting apparatus of FIG. 1.
Figure 4:
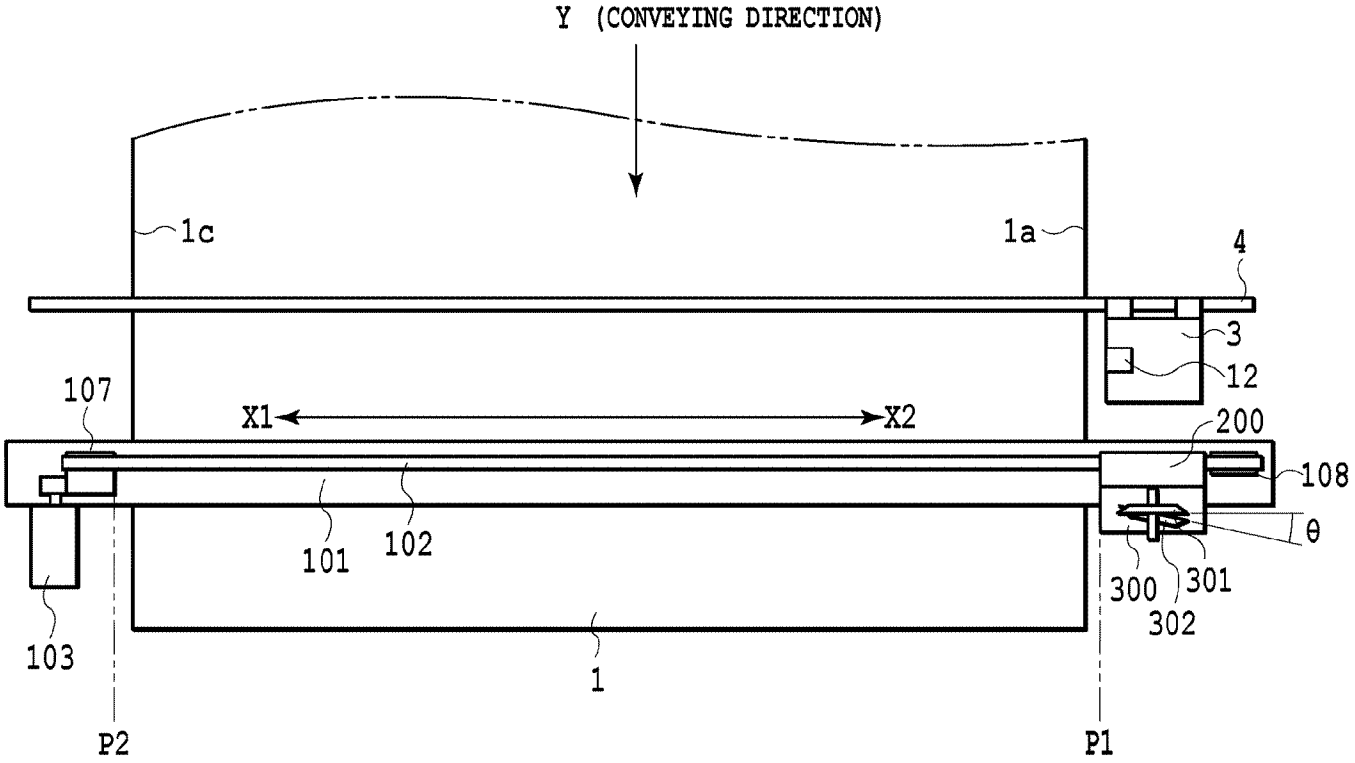
FIG. 4 is a plan view of the cutting apparatus.
Figure 5:
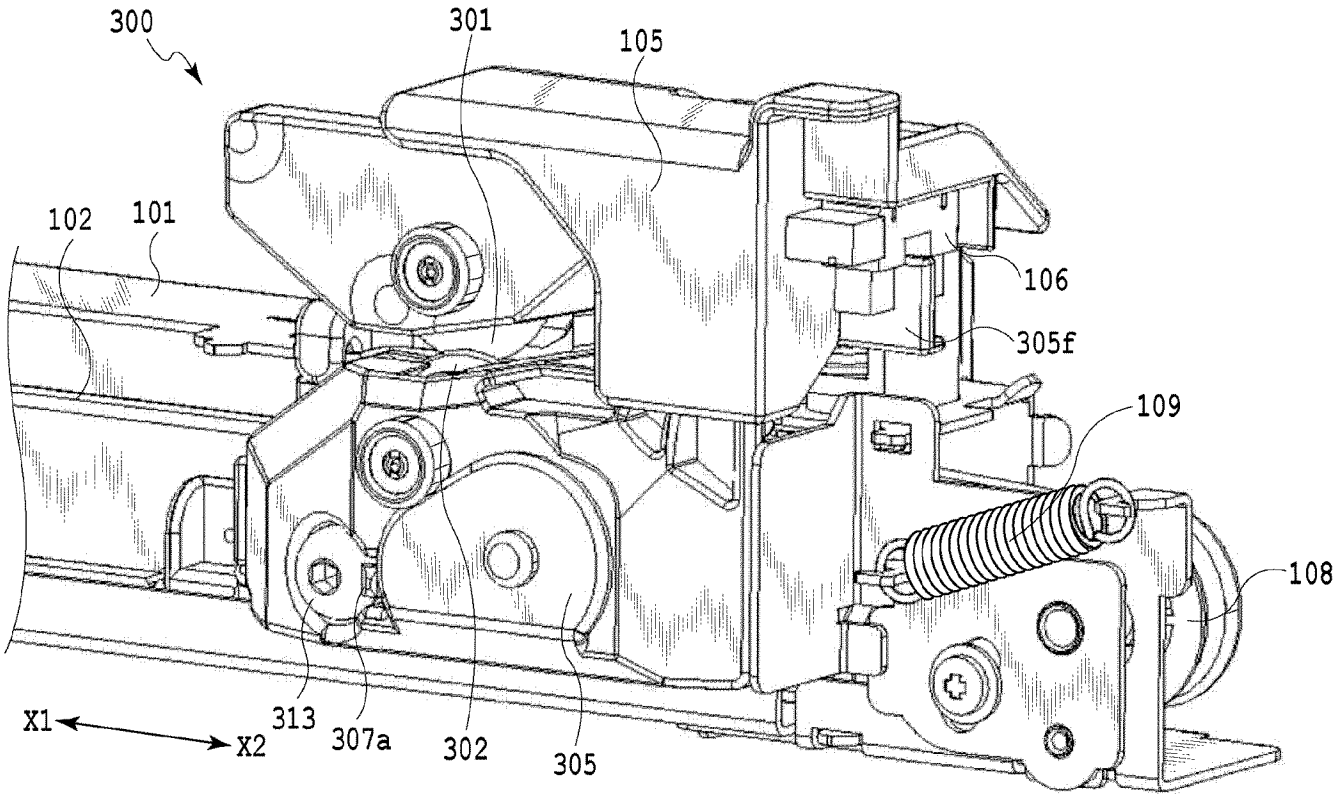
FIG. 5 is a perspective view of the cutting apparatus.

FIG. 3 is a perspective view of the entire cutting apparatus 5, FIG. 4 is a plan view of a peripheral portion of the cutting apparatus 5 provided in the printing apparatus 100, and FIG. 5 is a perspective view of main parts of the cutting apparatus 5.

The cutting apparatus 5 includes a guide rail 101, a toothed belt 102, a carriage 200, and a cutter unit 300. The guide rail 101 guides the carriage 200 in a direction crossing the conveying direction of the sheet 1 (the direction of the arrow Y) so that the carriage 200 can reciprocate. In the case of this embodiment, the carriage 200 is guided so as to be capable of reciprocating in the directions of arrows X1 and X2 orthogonal to the conveying direction. The carriage 200 is connected to the belt 102. The cutter motor 103 and a motor pulley 107 are disposed at one end of the guide rail 101, and a tensioner pulley 108 and a tensioner spring 109 are disposed at the other end of the guide rail 101. The belt 102 is stretched between the motor pulley 107 and the tensioner pulley 108. The tensioner pulley 108 is biased in the direction of the arrow X2 by the tensioner spring 109, so that tension is applied to the belt 102. For this reason, the tooth jump of the belt 102 is prevented.

As described below, the cutter unit 300 is attached to the carriage 200 so as to be capable of being replaced in a joining direction (an attaching direction). The cutter unit 300 includes a disc-shaped upper rotary blade 301 and a disc-shaped lower rotary blade 302 that can cut the sheet 1. These rotary blades 301 and 302 are disposed so as to cross each other at a predetermined angle θ (a crossing angle) with respect to a direction X1 that is a cutting direction as in FIG. 4, and the sheet 1 is cut at a contact point between the rotary blades 301 and 302. The cutter unit 300 reciprocates in the directions of the arrows X1 and X2 together with the carriage 200, and cuts the sheet 1 when moving in the direction of the arrow X1. As described below, the carriage 200 obtains torque from the relative movement of itself and the belt 102 and rotationally drives the lower rotary blade 302 by the torque. Accordingly, both the lower rotary blade 302 and the upper rotary blade 301, which is in contact with the lower rotary blade 302, rotate at the time of the cutting of the sheet 1.

The cutter unit 300 stands by at a stand-by position P1 provided outside an end portion 1*a* of the sheet 1 during the printing of images, and moves from the stand-by position P1 in the cutting direction, which is indicated by the arrow X1, at the time of the cutting of the sheet 1. After the cutting of the sheet 1, the cutter unit 300 is reversed at a reverse position P2 corresponding to the width of the sheet 1, returns to the stand-by position P1, and stands by at the stand-by position P1 by for the next cutting operation. The movement of the cutter unit 300 in the direction of the arrow X2 does not contribute to the cutting operation.

The movement position of the cutter unit 300 on the arrows X1 and X2 can be controlled on the basis of output signals (pulse signals) of the encoder 104 provided on the cutter motor 103. Since a relationship between the number of pulses of the encoder 104 and the moving distance of the cutter unit 300 has been known in advance, the moving distance of the cutter unit 300 is found out by the count of the number of pulses of the encoder 104. A sensor holder 105 is fixed at a fixed position in the vicinity of the stand-by position P1, and the sensor holder 105 is provided with the stand-by position sensor 106. A sensor flag part 305*f* provided on the cutter unit 300 is detected by the stand-by position sensor 106, so that the cutter unit 300 can be accurately stopped at the stand-by position P1. Further, whether or not the cutter unit 300 is present at the stand-by position P1 can also be detected by the stand-by position sensor 106.

(Structure of Carriage)

Figure 6:
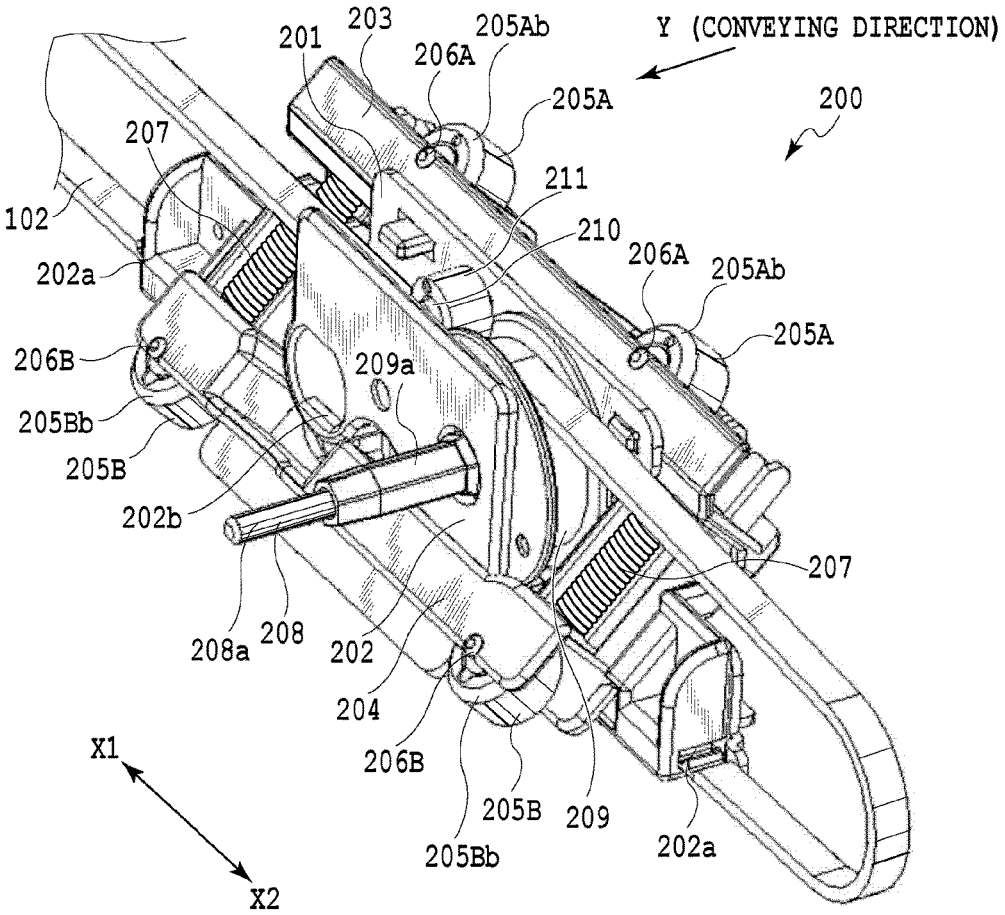
FIG. 6 is a perspective view of a cutter carriage of the cutting apparatus.
Figure 7:
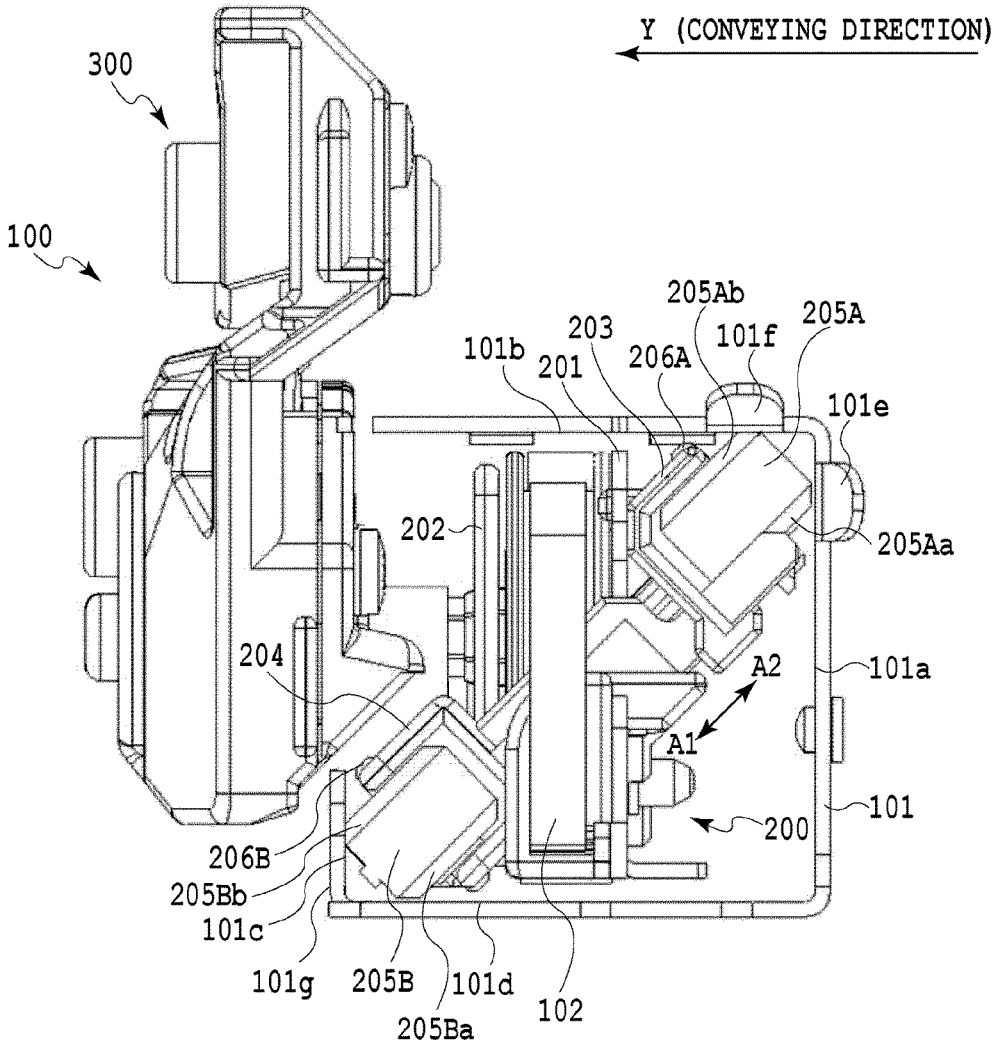
FIG. 7 is a side view of the cutting apparatus.

FIG. 6 is a perspective view of the carriage 200 and FIG. 7 is a side view of the cutting apparatus 5.

The carriage 200 is disposed in the guide rail 101 that includes four guide surfaces 101*a*, 101*b*, 101*c*, and 101*d* as described below. The carriage 200 includes a carriage chassis 201, a carriage holder 202, an upper roller holder (a first holder) 203, and a lower roller holder (a second holder) 204. Both end portions of the belt 102 are inserted and connected to a belt insertion portion 202*a* of the carriage holder 202. The carriage holder 202 is fixed to the carriage chassis 201. The roller holders 203 and 204 hold rollers (rotating bodies) as guide bodies are described below.

When a small gap is formed between the carriage 200 and the guide rail 101 for the smooth movement of the carriage 200 along the guide rail 101, the carriage 200 is displaced in the range of the gap. Since the rotary blades 301 and 302 of the cutter unit 300 are inclined to each other at the predetermined angle θ (the crossing angle) as described above, a force for displacing the cutter unit 300 to the upstream side in the conveying direction is applied to the cutter unit 300 during the cutting of the sheet 1. For this reason, there is a concern that the carriage 200 may be displaced to the upstream side in the conveying direction during the cutting of the sheet 1. When the position of the cutter unit 300 integrally attached to the carriage 200 is displaced from the time of the start of cutting, there is a case in which a cut portion of the sheet 1 may be bent with respect to the conveying direction. Accordingly, the carriage 200 needs to be disposed in the guide rail 101 without a gap therebetween, and the load of the carriage 200 during the movement of the carriage 200 needs to be reduced.

In this embodiment, a guide mechanism to be described below is provided between the guide rail 101 and the carriage 200.

The upper roller holder 203 is fixed to the carriage chassis 201, and two rollers (first guide bodies) 205A, which are rotatably supported by roller shafts 206A, are disposed on the upper roller holder 203 in the cutting direction of the sheet 1 as in FIG. 6. The lower roller holder 204 is held by the carriage holder 202 at a position facing the upper roller holder 203 so as to be slidable in the directions of arrows A1 and A2. That is, the roller holders 203 and 204 are guided so as to be movable in directions in which the roller holders 203 and 204 approach each other and are separated from each other. Two rollers (second guide bodies) 205B, which are rotatably supported by roller shafts 206B, are disposed on the lower roller holder 204 in the cutting direction of the sheet 1 as in FIG. 6. Pressing springs 207, which bias the upper and lower roller holders 203 and 204 in the direction in which the upper and lower roller holders 203 and 204 are separated from each other, are disposed between the upper and lower roller holders 203 and 204. Therefore, the upper roller holder 203 is biased in the direction of the arrow A2, that is, in a direction that is inclined toward the upstream side in the conveying direction and the upper side as in FIG. 7. The lower roller holder 204 is biased in the direction of the arrow A1, that is, in a direction that is inclined toward the downstream side in the conveying direction and the lower side as in FIG. 7.

The guide rail 101 includes a first guide surface 101*a*, a second guide surface 101*b*, a third guide surface 101*c*, and a fourth guide surface 101*d* that guide the rollers 205A and 205B. The first and second guide surfaces 101*a* and 101*b* are positioned on planes different from each other and form a first guide portion. The third and fourth guide surfaces 101*c* and 101*d* are positioned on planes different from each other and form a second guide portion. These first and second guide portions face each other inside the guide rail 101. In the case of this embodiment, the first and second guide surfaces 101*a* and 101*b* are positioned on two planes substantially perpendicular to each other. The third and fourth guide surfaces 101*c* and 101*d* are positioned on two planes substantially perpendicular to each other likewise. Further, the first and third guide surfaces 101*a* and 101*c* are substantially parallel to each other, and the second and fourth guide surfaces 101*b* and 101*d* are substantially parallel to each other. More specifically, the first and third guide surfaces 101*a* and 101*c* are surfaces orthogonal to the conveying direction of the sheet 1, and the first guide surface 101*a* is positioned on the upstream side of the third guide surface 101*c* in the conveying direction. The second and fourth guide surfaces 101*b* and 101*d* are surfaces orthogonal to a vertical direction, and the second guide surface 101*b* is positioned above the fourth guide surface 101*d*.

A tapered portion (a first portion to be guided) 205Aa is formed at one peripheral edge of two peripheral edges of the roller 205A, and a tapered portion (a second portion to be guided) 205Ab is formed at the other peripheral edge thereof. The upper roller holder 203, which is biased in the direction of the arrow A2, presses the tapered portion 205Aa against the first guide surface 101*a* and presses the tapered portion 205Ab against the second guide surface 101*b*. A tapered portion (a fourth portion to be guided) 205Ba is formed at one peripheral edge of two peripheral edges of the roller 205B, and a tapered portion (a third portion to be guided) 205Bb is formed at the other peripheral edge thereof. The lower roller holder 204, which is biased in the direction of the arrow A1, presses the tapered portion 205Ba against the fourth guide surface 101*d* and presses the tapered portion 205Bb against the third guide surface 101*c*. The pressing spring 207 biases the upper roller holder 203 in the direction of the arrow A2 toward a corner between the first and second guide surfaces 101*a* and 101*b*, and the pressing spring 207 biases the lower roller holder 204 in the direction of the arrow A1 toward a corner between the third and fourth guide surfaces 101*c* and 101*d*. Accordingly, since the tapered portions of the rollers 205A and 205B are reliably pressed against the corresponding guide surfaces of the guide rail 101 and the carriage 200 is disposed in the guide rail 101 without a gap therebetween, the stable posture of the carriage 200 can be maintained. Since the carriage 200 has a function to remove a gap between itself and the guide rail 101 as described above, the carriage 200 does not need to separately include a structure for removing the gap. Accordingly, the size of the apparatus can be reduced as much as that.

In this embodiment, two rollers are disposed on each of the upper and lower roller holders 203 and 204, that is, a total of four rollers are disposed. However, a total of three or more rollers may be disposed. That is, when a plurality of rollers are provided on one roller holder of the upper and lower roller holders 203 and 204 and two or more rollers are provided on the other roller holder thereof, the posture of the carriage 200 can be stabilized with respect to the guide rail 101. Further, two pressing springs 207 are provided between the upper and lower roller holders 203 and 204 in this embodiment. However, the number of the pressing springs 207 to be disposed may be one or more.

The carriage 200 is allowed to reciprocate in the directions of the arrows X1 and X2 through the belt 102 by the cutter motor 103. As the carriage 200 is moved, the rollers 205A and 205B provided on the upper and lower roller holders 203 and 204 rotate while being in contact with the corresponding guide surfaces 101*a*, 101*b*, 101*c*, and 101*d*. Accordingly, since the rollers 205A and 205B are always in contact with the guide rail 101 during the reciprocation of the carriage 200, the rollers 205A and 205B can restrict the position of the carriage 200 in the vertical direction and a horizontal direction in FIG. 7. As a result, the displacement of the cutter unit 300 mounted on the carriage 200 from the time of the start of cutting is suppressed, and the generation of the bending of the cut portion of the sheet 1 can be suppressed. Further, since the rollers 205A and 205B rotate, the load of the carriage 200 during the movement of the carriage 200 can be reduced.

Furthermore, in this embodiment, the upper roller holder 203 is fixed to the carriage chassis 201 and the lower roller holder 204 is provided so as to be movable relative to the carriage holder 202, which is fixed to the carriage chassis 201, in the directions of arrows A1 and A2. For this reason, even though a force in the direction of the arrow A2 (toward the upstream side in the conveying direction and the upper side) is applied to the carriage 200 mounted on the carriage chassis 201, the carriage 200 does not move in the direction of the arrow A2. Accordingly, even when the cutter unit 300 receives a force applied to the upstream side in the conveying direction due to the angle θ (the crossing angle) at the time of the cutting of the sheet, the carriage 200 does not move in the direction of the arrow A2 and the cutting position of the sheet 1 is restricted to a regular position.

Tapered guide portions 101*e* and 101*f*, which guide the carriage 200 when the carriage 200 is assembled from the side surface of the guide rail 101, are formed on the guide rail 101. The tapered guide portion 101*e* is formed so as to smoothly continue to the first guide surface 101*a*, which is positioned on the upstream side in the conveying direction, and is inclined toward the upstream side in the conveying direction. The tapered guide portion 101*f* is formed so as to smoothly continue to the second guide surface 101*b*, which is positioned on the upper side, and is inclined toward the upper side. When the tapered guide portions 101*e* and 101*f* are used, the carriage 200 can be easily assembled from the side surface of the guide rail 101. In addition, the same tapered guide portions may be provided on the third and fourth guide surfaces 101*c* and 101*d* for the improvement of the easy of assembly of the carriage 200.

The carriage chassis 201 is provided with a shaft 208 and a roller shaft 210. An output gear 209 is rotatably supported by the shaft 208, and a roller 211 is rotatably supported by the roller shaft 210. The output gear 209 and the roller 211 form a drive mechanism that rotationally drives the lower rotary blade 302 of the cutter unit 300 according to the relative movement of the carriage 200 and the belt 102. The output gear 209 is engaged with tooth portions of the belt 102. The roller 211 increases the degree of the engagement between the belt 102 and the output gear 209 by guiding the belt 102 so that the length of a portion of the belt 102 wound on the output gear 209 is increased, and suppresses the tooth jump between the belt 102 and the output gear 209. When the carriage 200 is allowed to reciprocate in the directions of the arrows X1 and X2 through the belt 102, the output gear 209 engaged with the belt 102 is rotated about the shaft 208. The output gear 209 forms a supply unit that supplies a force for driving the lower rotary blade 302 of the cutter unit 300. The output gear 209 is provided with an output portion 209*a* that is positioned on the outer peripheral portion of the shaft 208 and has a polygonal cross-section (a hexagonal cross-section in the case of this embodiment), and the output portion 209*a* protrudes on the downstream side in the conveying direction of the sheet 1. The output portion 209*a* transmits torque to the lower rotary blade 302 of the cutter unit 300 as described below.

(Structure of Cutter Unit)

Figure 8:
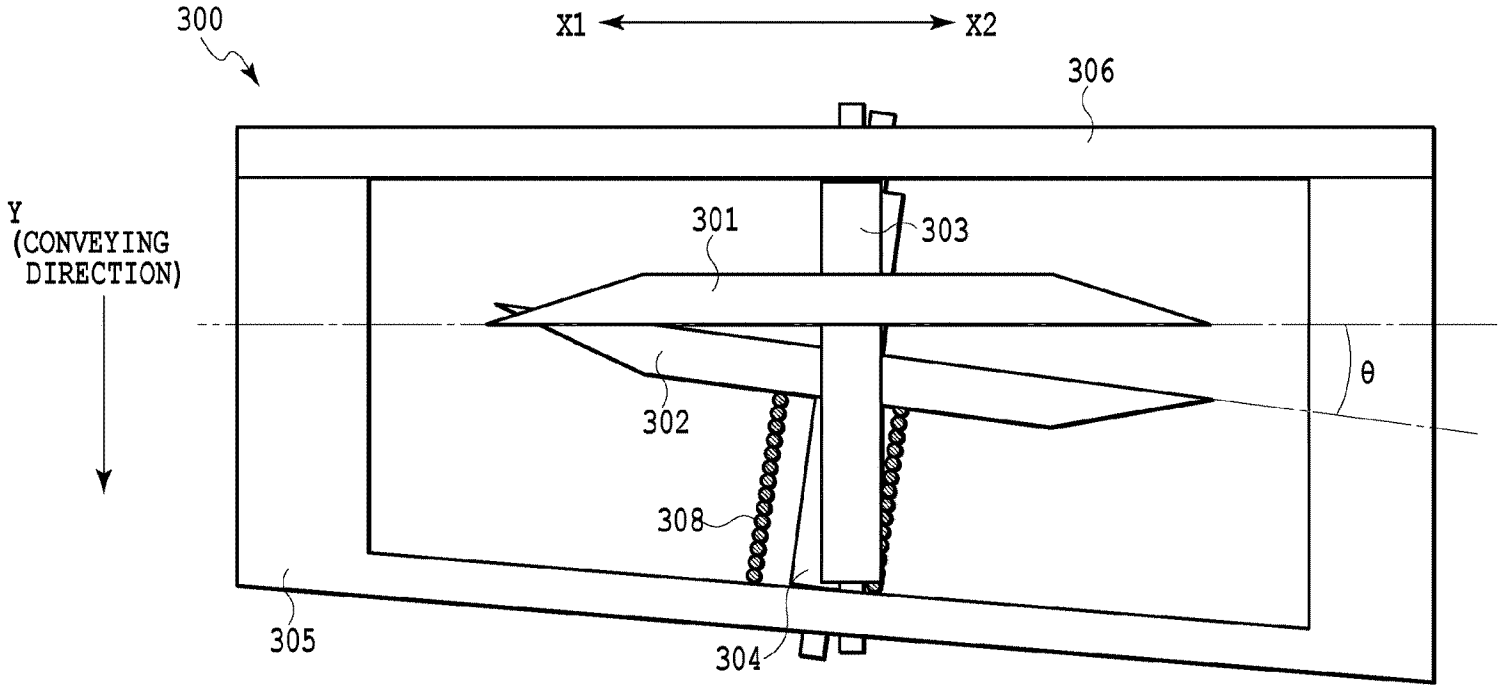
FIG. 8 is an enlarged view of main parts of a cutter unit of the cutting apparatus that are viewed from above.
Figure 9:
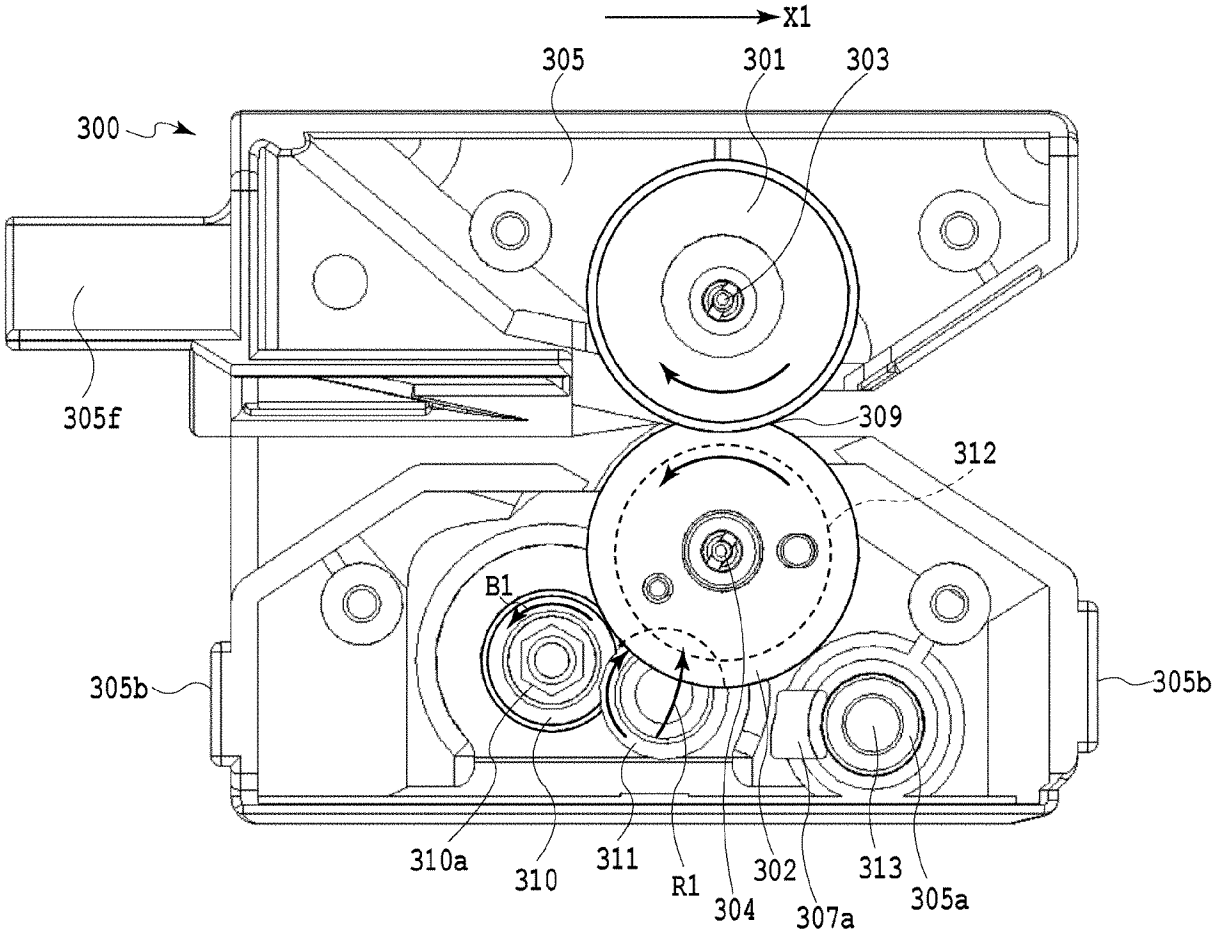
FIG. 9 is a front view of the cutter unit that is moving in a cutting direction.
Figure 10:
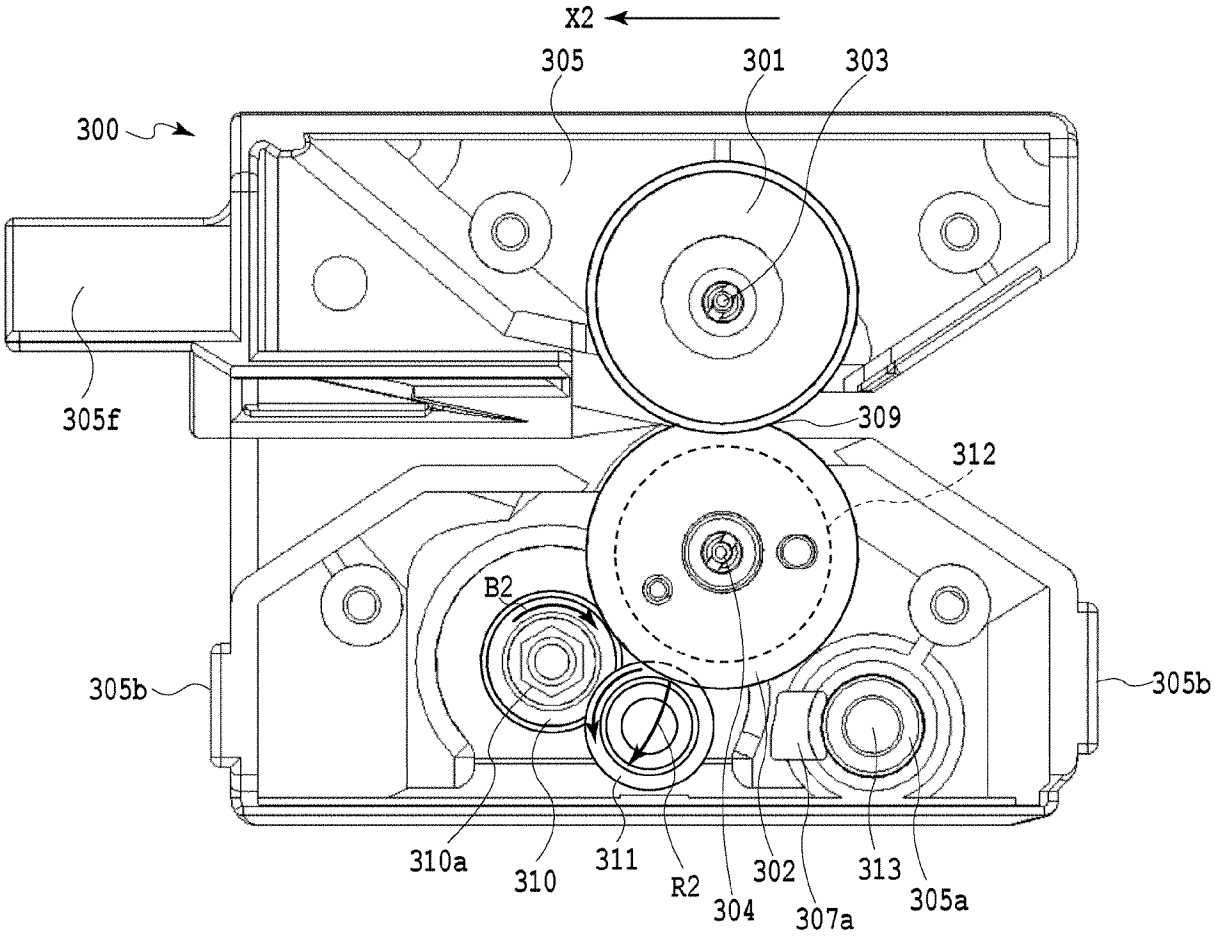
FIG. 10 is a front view of the cutter unit that is moving in a direction opposite to the cutting direction.

FIG. 8 is an enlarged view of the rotary blades 301 and 302 of the cutter unit 300 that are viewed from above, FIG. 9 is a front view when the cutter unit 300 moves in the direction of the arrow X1 (the cutting direction), and FIG. 10 is a front view when the cutter unit 300 moves in the direction of the arrow X2.

The upper rotary blade 301 is a disc-shaped round blade that can rotate integrally with an upper rotating shaft 303, and is disposed above a printed surface of the sheet 1 on which images have been printed. The lower rotary blade 302 is a disc-shaped round blade that can be rotated integrally with a lower rotating shaft 304, and is disposed below a surface of the sheet 1 opposite to the printed surface. The upper rotating shaft 303 is rotatably supported between a main holder 305 and an upper holder 306. The lower rotary blade 302 is disposed on the downstream side of the upper rotary blade 301 in the conveying direction of the sheet 1, and the lower rotating shaft 304 is rotatably supported between the main holder 305 and a lower holder 307 so that the lower rotary blade 302 forms a predetermined angle θ (the crossing angle) with respect to the cutting direction indicated by the arrow X1. Since the lower holder 307 is disposed so as to deviate from the upper holder 306 by a predetermined distance in the direction of the arrow X2, the lower rotating shaft 304 is inclined with respect to the vertical direction in FIG. 8 that is orthogonal to the cutting direction X1. For this reason, the lower rotary blade 302 is inclined with respect to the cutting direction, which is indicated by the arrow X1, by the predetermined angle θ (the crossing angle), so that the crossing angle θ is set. Since a pressing spring 308 positioned around the lower rotating shaft 304 is disposed between the lower rotary blade 302 and the main holder 305, the lower rotary blade 302 is pressed by the pressing spring 308 so as to be in point contact with the upper rotary blade 301. A contact point between the upper and lower rotary blades 301 and 302 forms a cutting point 309, and the sheet 1 is cut at the cutting point 309.

The crossing angle θ with respect to the cutting direction (the direction of the arrow X1) needs to be increased to improve cutting performance through the improvement of the bite of the rotary blades 302 and 301 on a sheet at the time of the start of the cutting of various sheets. However, since the cut surface of the sheet is peeled when the crossing angle θ is too large, there is a concern that much paper powder may be generated in a case in which the sheet is paper, that is, the quality of cutting may deteriorate. For this reason, the rotary blades 302 and 301 need to be positioned so that the crossing angle θ is set with high accuracy. The crossing angle θ is determined by the upper rotary blade 301 of which the position is set by the position of the upper holder 306 assembled to the main holder 305 and the lower rotary blade 302 of which the position is set by the position of the lower holder 307 assembled to the main holder 305. Since the position of each of the upper and lower holders 306 and 307 assembled to the main holder 305 can be finely adjusted, the crossing angle θ can be adjusted by the fine adjustment of the position of each of the upper and lower holders 306 and 307 assembled to the main holder 305. Each of the upper and lower holders 306 and 307 is fixed to the main holder 305 after the adjustment of the crossing angle θ, so that the crossing angle θ is maintained.

The cutter unit 300 includes an input gear 310, a pendulum gear 311, and a rotating gear 312 that forcibly rotate the lower rotary blade 302. The input gear 310 is provided with a hole-like input portion 310*a*, and an inner peripheral portion having a polygonal cross-section (a hexagonal cross-section in the case of this embodiment) is formed in the input portion 310*a*. When the output portion 209*a* of the carriage 200 is fitted to the input portion 310*a*, the output gear 209 and the input gear 310 are connected to each other. The output gear 209 rotates with the reciprocation of the carriage 200 as described above. The torque of the output gear 209 is transmitted to the input gear 310. That is, the input gear 310 is rotated in the directions of arrows B1 and B2 with the movement of the cutter unit 300.

The pendulum gear 311 transmits the unidirectional rotation of the input gear 310 to the rotating gear 312. That is, when the input gear 310 rotates in the direction of the arrow B1 of FIG. 9, the pendulum gear 311 rotates about the shaft of the input gear 310 in the direction of an arrow R1 and rotates to a position at which the pendulum gear 311 is engaged with the rotating gear 312. Then, the pendulum gear 311 transmits rotation to the rotating gear 312. Accordingly, the rotating gear 312 is rotated in the direction of an arrow of FIG. 9. On the other hand, when the input gear 310 rotates in the direction of an arrow B2 of FIG. 10, the pendulum gear 311 rotates about the shaft of the input gear 310 in the direction of an arrow R2 and is stopped at a position illustrated in FIG. 10 by a stopper (not illustrated). Accordingly, the pendulum gear 311 is not engaged with the rotating gear 312 and the rotating gear 312 is not rotated. Since the rotating gear 312 is mounted on the lower rotating shaft 304, the lower rotary blade 302 is also rotated by the rotation of the rotating gear 312. Since the upper rotary blade 301 and the lower rotary blade 302 are in contact with each other at the cutting point 309, the upper rotary blade 301 is driven to rotate when the lower rotary blade 302 rotates.

When the cutter unit 300 is moved in the cutting direction indicated by the arrow X1, the upper and lower rotary blades 301 and 302 rotate in a direction in which these rotary blades 301 and 302 pull the sheet 1 to the cutting point 309 as in FIG. 9. The sheet 1 can be easily cut by the cooperation of the upper and lower rotary blades 301 and 302 that rotate in this way. On the other hand, since the rotation of the pendulum gear 311 is not transmitted to the rotating gear 312 as in FIG. 10 when the cutter unit 300 is moved in the direction of the arrow X2, the upper and lower rotary blades 301 and 302 do not rotate. Accordingly, the wear of the upper and lower rotary blades 301 and 302 is suppressed. As a result, the durability of the upper and lower rotary blades 301 and 302 can be improved.

(Attachment and Detachment of Cutter Unit)

Figure 11:
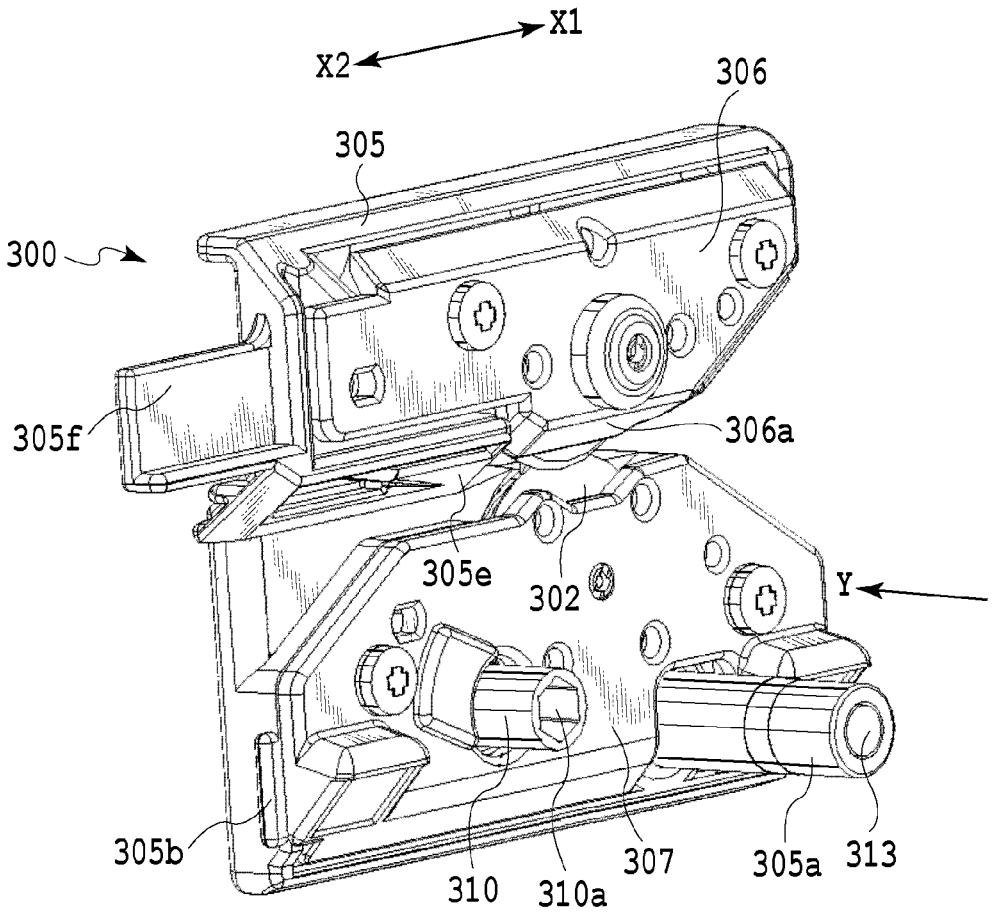
FIG. 11 is a perspective view of the cutter unit that is viewed from the back side.
Figure 12:
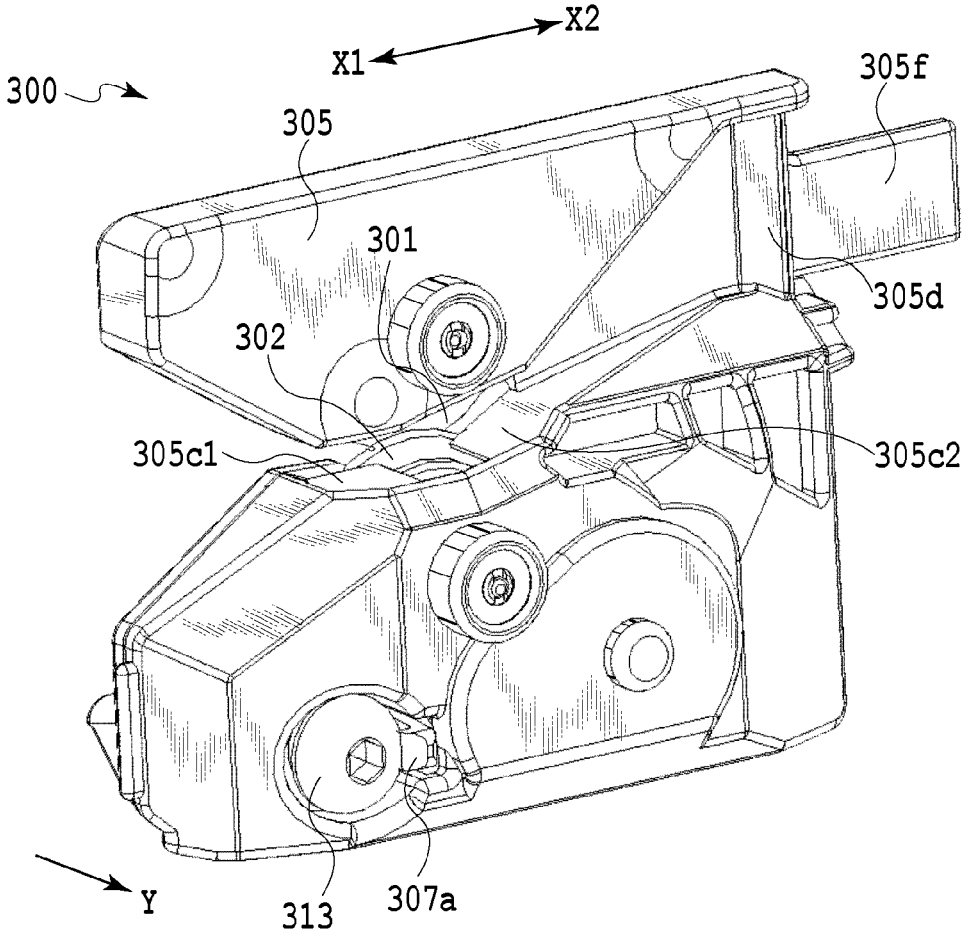
FIG. 12 is a perspective view of the cutter unit that is viewed from the front side.
Figure 13:
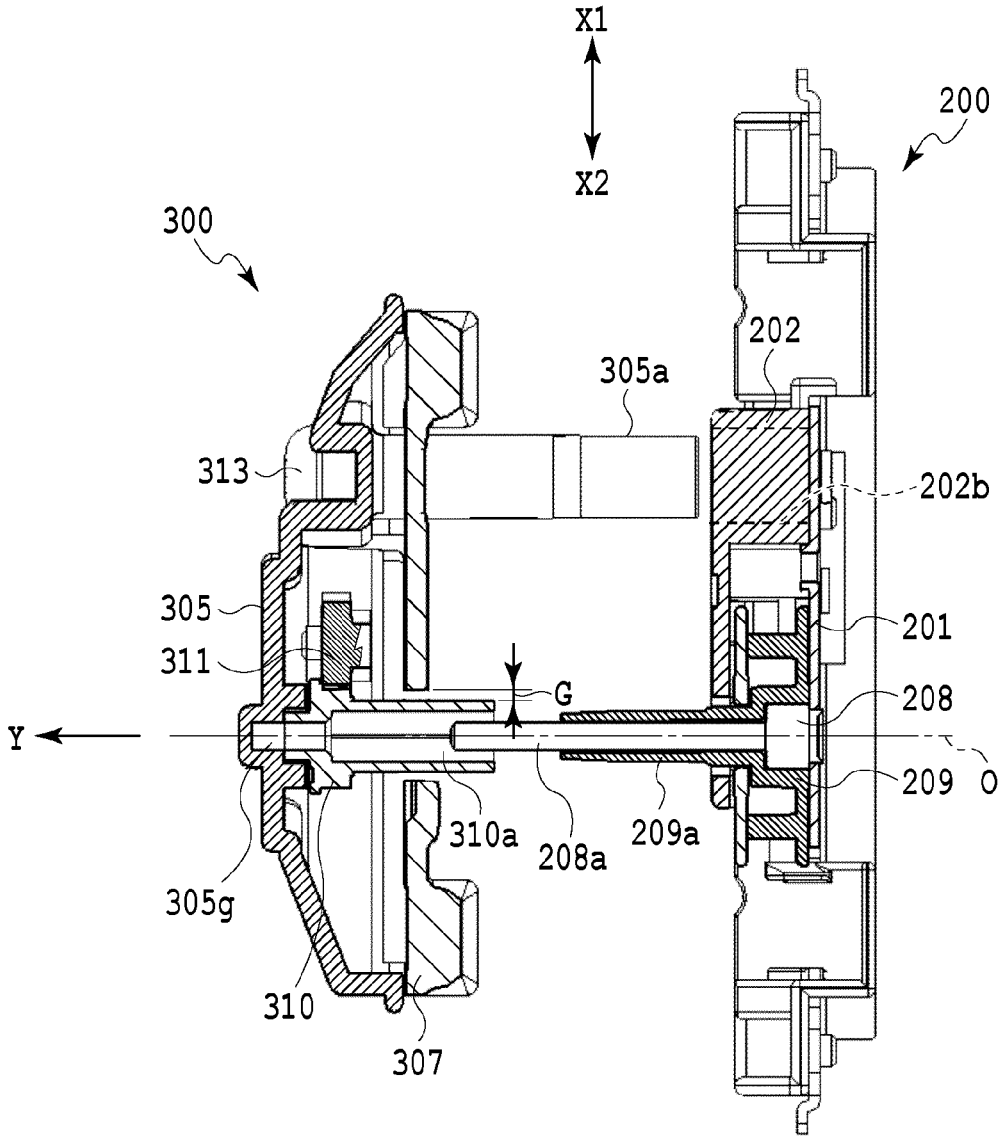
FIG. 13 is a cross-sectional view of main parts of the cutter unit at the time of the start of the mounting of the cutter unit.
Figure 14:
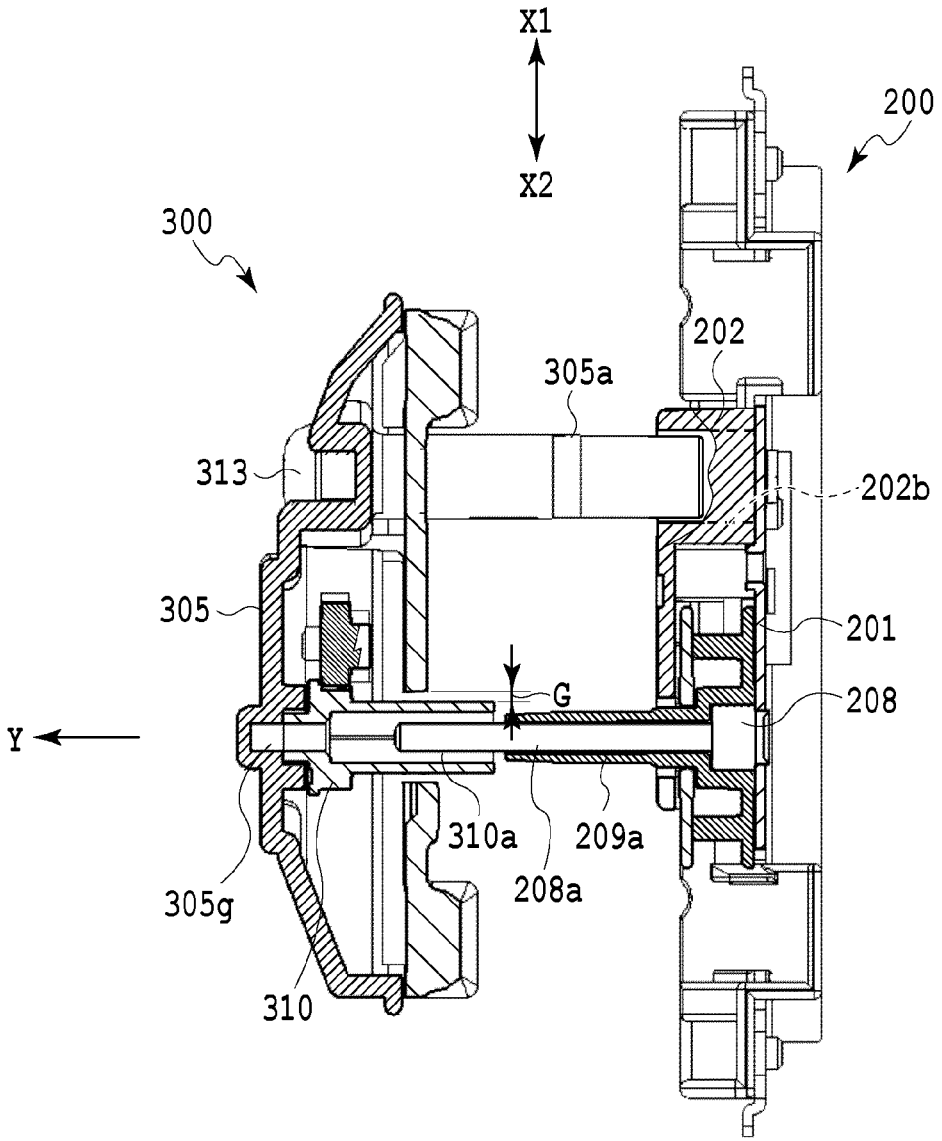
FIG. 14 is a cross-sectional view of main parts of the cutter unit during the mounting of the cutter unit.
Figure 15:
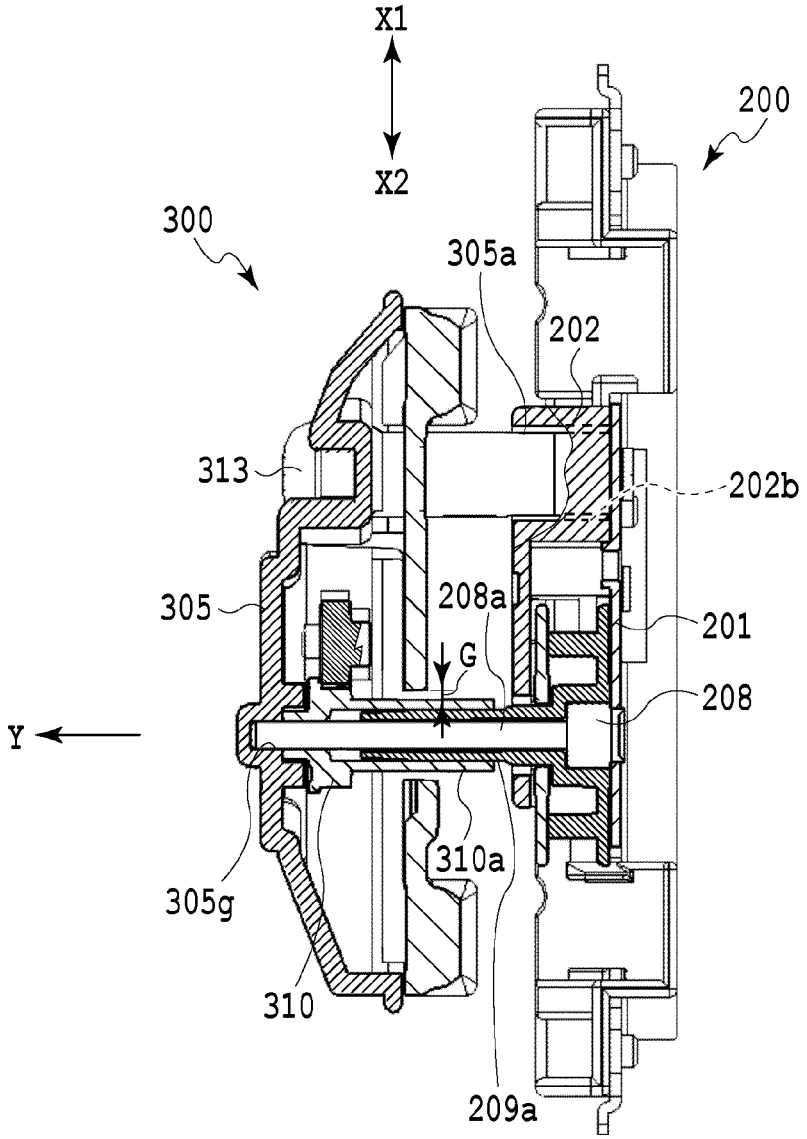
FIG. 15 is a cross-sectional view of main parts of the cutter unit after the mounting of the cutter unit.

The cutter unit 300 is attached to the carriage 200 so as to be capable of being replaced. That is, the cutter unit 300 can be attached to and detached from the carriage 200. FIG. 11 is a perspective view of the cutter unit 300 that is viewed from the back side, and FIG. 12 is a perspective view of the cutter unit 300 that is viewed from the front. FIG. 13 is a cross-sectional view of main parts of the cutter unit 300 at the time of the start of the mounting of the cutter unit 300, FIG. 14 is a cross-sectional view of main parts of the cutter unit 300 during the mounting of the cutter unit 300, and FIG. 15 is a cross-sectional view of main parts of the cutter unit after the mounting of the cutter unit 300.

The shaft 208 of the carriage 200 includes a tip portion 208*a* that protrudes from the tip of the output portion 209*a* toward the downstream side in the conveying direction, and the main holder 305 of the cutter unit 300 includes a positioning hole 305*g*. When the tip portion 208*a* of the shaft 208 is fitted to the positioning hole 305*g*, the cutter unit 300 is positioned. Further, the carriage holder 202 includes a positioning hole 202*b* for the cutter unit 300, and the main holder 305 includes a positioning portion 305*a*. When the positioning portion 305*a* is fitted to the positioning hole 202*b*, the cutter unit 300 is positioned in a direction in which the cutter unit 300 rotates about the output portion 209*a*. When the tip portion 208*a* of the shaft 208 is fitted to the positioning hole 305*g* and the positioning portion 305*a* is fitted to the positioning hole 202*b* as described above, the cutter unit 300 is positioned relative to the carriage 200. When the output portion 209*a* of the carriage 200 is fitted to the input portion 310*a* of the cutter unit 300 as described above, the output gear 209 and the input gear 310 are connected to each other and a driving force transmission system for the lower rotary blade 302 is formed. That is, the output portion 209*a* and the input portion 310*a* form a transmission mechanism that transmits a driving force (rotational driving force) supplied from the carriage 200 to the lower rotary blade 302 of the cutter unit 300. The output portion 209*a*, the input portion 310*a*, the tip portion 208*a* of the shaft 208, and the positioning hole 305*g* are disposed so as to be positioned on the same axis O (see FIG. 13) extending in a joining direction in which the carriage 200 and the cutter unit 300 are joined together (a direction in which the cutter unit 300 is attached to the carriage 200).

When the tip portion 208*a* of the shaft 208 is fitted to the positioning hole 305*g* in this way, the cutter unit 300 is positioned and the driving force transmission system for the lower rotary blade 302 is connected by the connection between the output gear 209 and the input gear 310 positioned on the same axis as the shaft 208. That is, the positioning of the cutter unit 300, which is the former, and the connection of the driving force transmission system for the lower rotary blade 302, which is the latter, can be performed without interfering with each other on the same axis. Since both the functions are collectively achieved on the same axis, the workability of the mounting of the cutter unit 300 can be improved and a space can be saved in comparison with a case in which portions where these functions are achieved are set to positions spaced apart from each other. If portions where both the functions are achieved are set to separate positions spaced apart from each other, individual fitting work needs to be performed at each of these portions and the fitting of the other portion is difficult when one portion is fitted first. Further, the output portion 209*a* is set to be longer than the positioning portion 305*a* in this embodiment so that the positioning portion 305*a* is inserted into the positioning hole 202*b* after the output portion 209*a* is inserted into the input portion 310*a*. When an order of fitting is set in this way, the workability of the mounting of the cutter unit 300 can be more improved.

A receiving portion, which receives a fixing screw 313, is formed in the positioning portion 305*a*. The positioning portion 305*a* has the shape of a cylinder that extends in the joining direction in which the cutter unit 300 is joined, and the fixing screw 313 is disposed so as to be positioned on the central axis of the positioning portion 305*a*. When the fixing screw 313 is screwed into a portion of the carriage chassis 201 that is positioned on the bottom of the positioning hole 202*b*, the cutter unit 300 is fixed to the carriage 200. A function to position the cutter unit 300 by the positioning portion 305*a* and the positioning hole 202*b* and a function to fix the cutter unit 300 by the fixing screw 313 provided in the positioning portion 305*a* are collectively achieved on the same axis in this way. Accordingly, the workability of the mounting of the cutter unit 300 can be improved and a space can be saved in comparison with a case in which portions where these functions are achieved are set to separate positions spaced apart from each other. Further, the positioning portion 305*a* and the positioning hole 202*b* function as a rotation preventing mechanism that prevents the relative rotation of the carriage 200 and the cutter unit 300 about the axis O.

The main holder 305 is provided with a claw 307*a*, which is caught on the head of the fixing screw 313, to prevent the falling of the fixing screw 313 provided in the positioning portion 305*a*. Accordingly, when the cutter unit 300 is detached from the carriage 200, the falling of the fixing screw 313 can be prevented. The position of the claw 307*a* is set so that the fixing screw 313 is received in the positioning portion 305*a* over the entire length thereof in a state in which the head of the fixing screw 313 is caught on the claw 307*a* and the falling of the fixing screw 313 is prevented. When the cutter unit 300 is mounted on the carriage 200, the generation of damage and the like caused by the contact between the tip portion of the fixing screw 313 and a peripheral portion of the positioning hole 202*b* can be prevented since the tip portion of the fixing screw 313 is received in the positioning portion 305*a*. As in FIGS. 11 and 12, the fixing screw 313 is disposed on a front side of the cutter unit 300 in the cutting direction (the direction of the arrow X1), and the input portion 310*a* is disposed on a rear side of the cutter unit 300 in the cutting direction. Since the fixing screw 313 is disposed on the front side in the cutting direction, the cutting resistance of the sheet 1 can be effectively received by a portion that is fixed by the fixing screw 313, the wobble of the cutter unit 300 can be prevented, and the posture of the cutter unit 300 can be stabilized.

When the cutter unit 300 is mounted on the carriage 200, the tip portion 208*a* of the shaft 208 is inserted into the input portion 310*a* first as in FIG. 13. The tip portion 208*a* is thinner than the output portion 209*a* and has a tapered shape, the diameter of the tip portion 208*a* is set to be sufficiently smaller than the inner diameter of the input portion 310*a*, and the tip portion 208*a* serves as an initial guide portion when the cutter unit 300 is mounted. That is, the position of the cutter unit 300 is roughly restricted by the fitting of the tip portion 208*a* to the input portion 310*a*. Since the tip portion 208*a* is set to be longer than the positioning portion 305*a* as described above, the positioning portion 305*a* is not yet inserted into the positioning hole 202*b* in a state in which the tip portion 208*a* starts to be inserted into the input portion 310*a* as in FIG. 13.

Further, the input gear 310 is allowed to oscillate and slide with respect to the insertion direction of the shaft 208 by a gap G as in FIG. 13, in a state in which the cutter unit 300 is detached from the carriage 200. That is, the input gear 310 in which the input portion 310*a* is formed can be displaced in a direction crossing the joining direction in which the cutter unit 300 is attached to the carriage 200. This gap G may allow the input gear 310 to only oscillate or to only slide. Furthermore, since the gap G is set so as to allow the input gear 310 to be inclined in a range in which at least the tooth bottom of the input gear 310 and the tooth bottom of the pendulum gear 311 do not come into contact with each other, the input gear 310 can be slightly inclined with respect to the cutter unit 300.

Accordingly, even though the position of the cutter unit 300 relative to the carriage 200 slightly deviates when the cutter unit 300 is attached to the carriage 200, the input portion 310*a* guides the output portion 209*a* while being inclined. As a result, the workability of the mounting of the cutter unit 300 can be improved. In addition, in order to secure a clear view, a user can mount the cutter unit 300 so that the cutter unit 300 is inclined.

Here, the input portion 310*a* and the output portion 209*a* have the same color (which means the same color or a similar color in this specification) that is different from the colors of other peripheral components. Accordingly, even when a user mounts the cutter unit 300 for the first time, the user can visually understand a relationship between the input portion 310*a* and the output portion 209*a* and can easily fit the output portion 209*a* to the input portion 310*a*.

When the cutter unit 300 is further inserted, the positioning portion 305*a* is inserted into the positioning hole 202*b* as in FIG. 14. At this time, the output portion 209*a* is not inserted into the input portion 310*a*. For this reason, since the cutter unit 300 can be moved in a range that is restricted by the input portion 310*a* and the tip portion 208*a*, the positioning portion 305*a* is easily inserted into the positioning hole 202*b*.

After that, when the cutter unit 300 is still further inserted, the output portion 209*a* is inserted into the input portion 310*a* as in FIG. 15. Accordingly, the output portion 209*a* and the input portion 310*a* are connected to each other. Further, since the tip portion 208*a* is inserted into the positioning hole 305*g*, the cutter unit 300 is positioned relative to the carriage 200. Accordingly, after the positioning portion 305*a* is inserted into the positioning hole 202*b* as in FIG. 14, the output portion 209*a* is inserted into the input portion 310*a* and the tip portion 208*a* is inserted into the positioning hole 305*g* as in FIG. 15. Since the timing of insertion of the positioning portion 305*a*, the timing of insertion of the output portion 209*a* and the tip portion 208*a* are shifted from each other in this way, the workability of mounting can be improved in comparison with a case in which the positioning portion 305*a*, the output portion 209*a*, and the tip portion 208*a* are simultaneously inserted.

As described above, the shaft (shaft portion) 208, the positioning hole 305*g* to which the shaft 208 is fitted, the output portion 209*a*, and the input portion 310*a* to which the output portion 209*a* is inserted form first fitting sections that are provided at positions, which face each other, on the carriage 200 and the cutter unit 300. Further, the protruding shaft 208 and the protruding output portion 209*a* form a carriage-side protruding portion, and the recessed positioning hole 305*g* and the input portion 310*a* form a cutter unit-side recessed portion. Furthermore, the positioning hole 202*b* and the positioning portion 305*a* form second fitting sections that are provided at positions, which face each other, on the carriage 200 and the cutter unit 300. Moreover, the recessed positioning hole 202*b* forms a carriage-side recessed portion, and the protruding positioning portion 305*a* forms a cutter unit-side protruding portion. Accordingly, the joining of the first fitting sections starts before the joining of the second fitting sections. More specifically, after the loose fitting of the shaft 208 to the input portion 310*a* starts, the fitting of the output portion (protruding transmission portion) 209*a* to the input portion (recessed transmission portion) 310*a* starts and the fitting of the shaft 208 to the positioning hole 305*g* then starts. Further, the fitting of the positioning portion 305*a* to the positioning hole 202*b* starts as in FIG. 14 between the start of the loose fitting of the shaft 208 to the input portion 310*a* and the start of the fitting of the output portion 209*a* to the input portion 310*a*. Since the timings of the start of the fitting of the respective portions to be fitted are shifted from each other in this way, the workability of the attaching of the cutter unit 300 can be improved.

The tip portion 208*a* of the shaft 208 has a sufficient length, and the length of the tip portion 208*a* is a length that allows the cutter unit 300 not to fall from the carriage 200 even though a user gets one's hand off the cutter unit 300 after the cutter unit 300 is positioned as in FIG. 15. For example, the length of the tip portion 208*a* is set so that the tip (the left end in FIG. 15) of the tip portion 208*a* is positioned on the left side of the centroid of the cutter unit 300 in FIG. 15 when the cutter unit 300 is positioned relative to the carriage 200 as in FIG. 15. Since the falling of the cutter unit 300 caused by gravity is prevented as described above, a user gets one's hand off the cutter unit 300 and can fix the cutter unit 300 by the fixing screw 313 after positioning the cutter unit 300 as in FIG. 15. As a result, the workability of the mounting of the cutter unit 300 is improved.

When the cutter unit 300 is not present at a correct position during the work for mounting the cutter unit 300, there is a concern that the tip portion 208*a* of the shaft 208 may come into contact with the upper and lower rotary blades 301 and 302. That is, when the tip portion 208*a* faces the rotary blades 301 and 302 at the time of the attaching of the cutter unit 300, there is a concern that the tip portion 208*a* may come into contact with the rotary blades 301 and 302. Accordingly, the guide rail 101 is provided with an abutment portion 101*g* (see FIG. 7) in this embodiment. The abutment portion 101*g* comes into contact with the positioning portion 305*a* of the cutter unit 300 so as to prevent the tip portion 208*a* from coming into contact with the upper and lower rotary blades 301 and 302 before the tip portion 208*a* comes into contact with the rotary blades 301 and 302. A position where a portion such as the abutment portion 101*g* coming into contact with the positioning portion 305*a* is provided is not limited to the guide rail 101, and the portion such as the abutment portion 101*g* may be provided on a component of the carriage 200 or a component other than the cutting apparatus 5. The positioning portion 305*a* and the abutment portion 101*g* form a pair of opposite portions that can come into contact with each other when the tip portion 208*a* faces the rotary blades 301 and 302 at the time of the attaching of the cutter unit 300.

Handhold parts 305*b* (see FIG. 9) are provided on both side surfaces of the main holder 305 so that a user stably holds the cutter unit 300 with hands at the time of the attachment and detachment of the cutter unit 300. As in FIG. 9, the handhold parts 305*b*, the input portion 310*a*, the positioning portion 305*a*, and the fixing screw 313 are disposed on substantially the same straight line in the directions of the arrows X1 and X2. Accordingly, the holding property and operability of the cutter unit 300 at the time of the attachment and detachment of the cutter unit 300 can be ensured. Further, when the cutter unit 300 is formed in a shape in which a portion of the cutter unit 300 other than the handhold parts 305*b* has a small area so as not to be easily held, a user can easily recognize the handhold parts 305*b* as handles even when attaching and detaching the cutter unit 300 for the first time.

(Outer Shape of Cutter Unit)

As in FIGS. 11 and 12, the main holder 305 includes a support portion 305*c*1, a support portion 305*c*2, a push-out portion 305*d*, and a guide portion 305*e*, and the upper holder 306 includes a guide portion 306*a*. When a sheet 1 having a short cutting length is cut by the cutter unit 300, the behavior of the cut sheet is unstable. For this reason, there is a concern that the sheet may enter the guide rail 101. In this state, when the cutter unit 300 having completely performed a cutting operation moves in the direction X2, there is a concern that a malfunction may be caused by the contact between the cutter unit 300 and the sheet having entered the guide rail 101. Accordingly, in this embodiment, the back of the cut sheet is supported by the support portions 305*c*1 and 305*c*2. That is, the support portion 305*c*1 extends toward the upstream side in the cutting direction (the direction of the arrow X1) from the vicinity of the cutting point (cutting portion) 309 (see FIG. 9) between the upper and lower rotary blades 301 and 302, and is positioned on the downstream side in the conveying direction of a sheet 1. The support portion 305*c*2 extends toward the downstream side in the cutting direction from the vicinity of the cutting point 309, and is positioned on the downstream side in the conveying direction of the sheet 1. Accordingly, when the sheet 1 is cut, a portion, which is not yet cut, of the sheet 1 is supported by the support portion 305*c*1 and the cut portion of the sheet 1 is supported by the support portion 305*c*2. As a result, the sheet 1 can be cut in a stable posture and the cut sheet can be reliably discharged.

Further, in a case in which a rear end of the cut sheet enters the cutting point 309 between the upper and lower rotary blades 301 and 302 when the cutter unit 300 returns in the direction of the arrow X2 after the cutting of the sheet 1, there is a concern that the rear end of the cut sheet 1 may be cut again. Accordingly, the rear end of the cut sheet 1 is pushed out by the push-out portion 305*d* in this embodiment. That is, since the push-out portion 305*d* protrudes toward the downstream side of the cutting point 309 in the conveying direction of the sheet 1, the push-out portion 305*d* pushes out the cut sheet to the downstream side in the conveying direction when the cutter unit 300 returns in the direction of the arrow X2. Accordingly, it is possible to prevent the rear end portion of the cut sheet from being cut again.

Further, in a case in which an end portion of the remaining sheet 1 without being cut off comes into contact with the main holder 305 and the upper holder 306 when the cutter unit 300 returns in the direction of the arrow X2 after the cutting of the sheet 1, there is a concern that a printed surface of the remaining sheet 1 on which images have been printed may be damaged. Accordingly, the guide portion 305*e* and the guide portion 306*a* have been provided in this embodiment. These guide portions 305*e* and 306*a* are positioned on a side, which faces the printed surface of the sheet 1 on which images have been printed, and on the upstream side in the conveying direction; and are formed in a tapered shape that is inclined upward toward the upstream side in the conveying direction. These guide portions 305*e* and 306*a* guide the end portion of the remaining sheet 1 when the cutter unit 300 returns in the direction of the arrow X2. Accordingly, since the contact between the end portion of the sheet 1 and the holders 305, 306 is avoided or a contact region is limited to only the tip portion of the end portion of the sheet 1, damage to the printed surface can be suppressed.

(Replacement of Cutter Unit)

Figure 16:
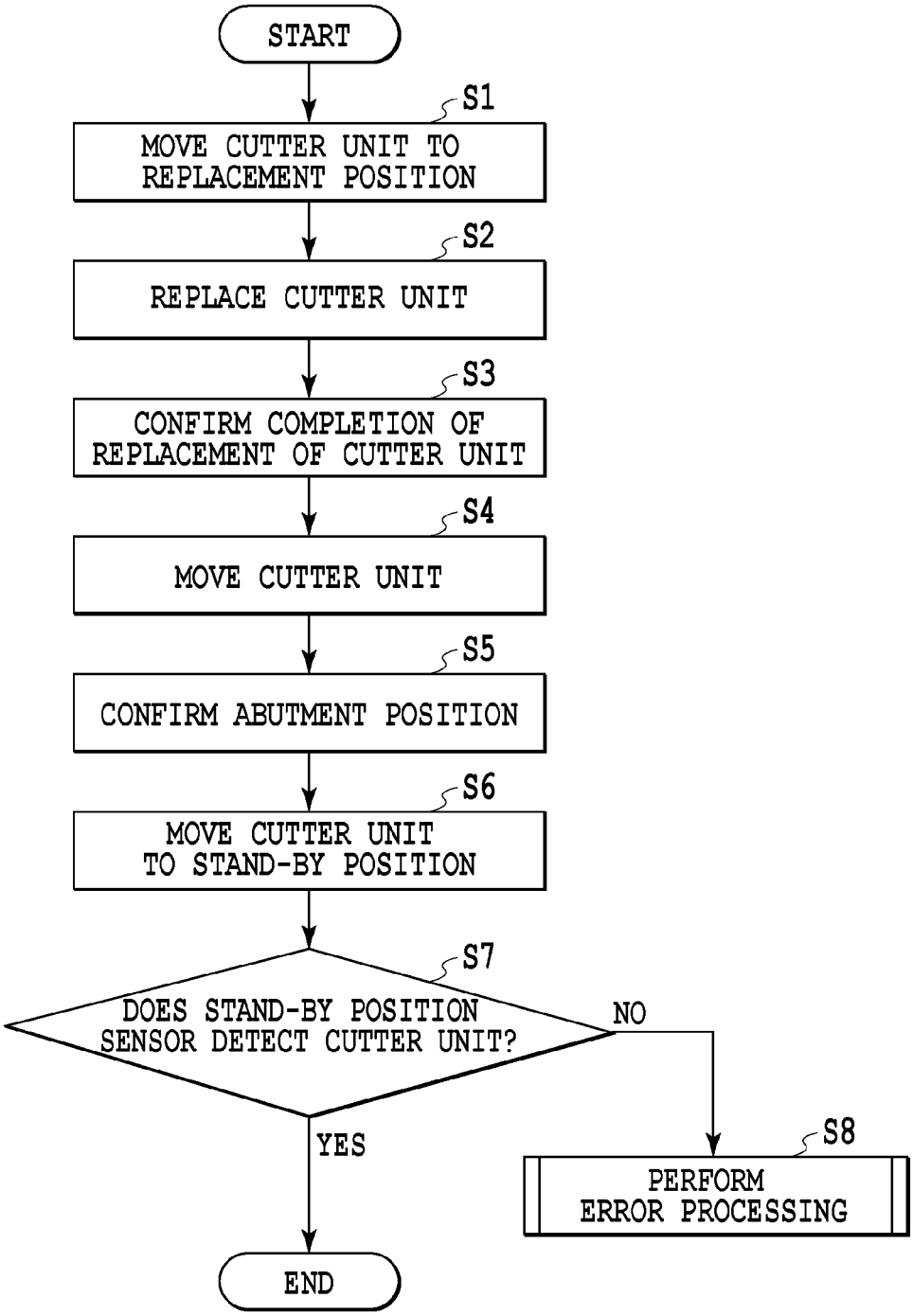
FIG. 16 is a flowchart illustrating an operation at the time of the replacement of the cutter unit.

FIG. 16 is a flowchart illustrating an operation at the time of the replacement of the cutter unit 300.

First, when a replacement mode of the cutter unit 300 is selected on an operation unit (not illustrated) of the printing apparatus 100, the cutter unit 300 is moved to a predetermined replacement position together with the carriage 200 (Step S1). The replacement position is a position at which a user easily replaces the cutter unit 300, and is set at, for example, a substantially middle position or the like of a region in which the cutter unit 300 moves in the directions of the arrows X1 and X2. Next, the cutter unit 300 is detached through the separation of the fixing screw 313, and a new cutter unit 300 is fixed instead of the cutter unit 300 by the fixing screw 313 after being positioned on the carriage 200 as described above (Step S2). When the completion of the replacement of the cutter unit 300 from the operation unit of the printing apparatus 100 is input after the cutter unit 300 is replaced in this way, the completion of the replacement of the cutter unit 300 is confirmed (Step S3). After that, the carriage 200 is moved in the direction of the arrow X1 (Step S4) so that a part of the carriage 200 abuts on a stopper (not illustrated) of the cutter motor 103 side. The abutment position of the carriage 200 is confirmed by the detection of the change of the load of the cutter motor 103 (Step S5).

Since it is difficult for the tooth jump of the belt 102 to occur at the time of the abutment due to the following reason, the abutment position can be accurately recognized by the reliable detection of the change of the load of the cutter motor 103. Both end portions of the belt 102, that is, one end portion of the belt 102 corresponding to the motor pulley 107 and the other end portion of the belt 102 corresponding to the tensioner pulley 108 are connected to the belt insertion portion 202*a* of the carriage holder 202 as described above. The length of a portion of the belt 102, which is positioned between one end portion of the belt 102 and the motor pulley 107, is relatively short. Since a portion of the belt 102, which is positioned between the other end portion of the belt 102 and the motor pulley 107, is turned back through the tensioner pulley 108, the length of the portion of the belt 102 is relatively long. When the carriage 200 is moved in the direction of the arrow X1 to allow the carriage 200 so as to abut on the stopper, the former short portion of the belt 102 pulls the cutter unit 300. Accordingly, the amount of elongation of the former short portion of the belt 102 is small and it is difficult for the tooth jump between the belt 102 and the motor pulley 107 to occur. If the carriage 200 is moved in the direction of the arrow X2 to as to abut on a stopper (not illustrated) of the tensioner pulley 108 side, the latter long portion of the belt 102 pulls the cutter unit 300. For this reason, the amount of elongation of the latter long portion of the belt 102 is large and tooth jump is likely to occur between the belt 102 and the motor pulley 107.

After the abutment position is confirmed in Step S5, the carriage 200 is moved in the direction of the arrow X2 on the basis of the abutment position by position control based on the output signals (pulse signals) of the encoder 104 and is positioned at the stand-by position P1 (Step S6). Then, it is determined whether or not the sensor flag part 305*f* of the cutter unit 300 is detected by the stand-by position sensor 106 provided at the stand-by position P1 (Step S7). If the sensor flag part 305*f* is detected, it is determined that the cutter unit 300 is correctly replaced and a series of processing ends. On the other hand, if the sensor flag part 305*f* is not detected, it is determined that the cutter unit 300 is not normally mounted or the movement of the carriage 200 is not normal and error processing, such as notifying a user of the contents of the determination, is performed (Step S8).

(Structure of Unit)

Since each of the carriage 200 and the cutter unit 300 of the cutting apparatus 5 is unitized, the carriage 200 and the cutter unit 300 can be attached to each other and detached from each other. Since the rotary blades 301 and 302 are provided in the unitized cutter unit 300, the cutter unit 300 has only to be replaced when the rotary blades 301 and 302 need to be replaced due to the abrasion or the like of the rotary blades 301 and 302. If the rotary blades 301 and 302 are assembled in the cutting apparatus 5 while the carriage 200 and the cutter unit 300 are not unitized, the cutting apparatus 5 should be disassembled for the replacement of the rotary blades 301 and 302, therefore the replacement of the rotary blades 301 and 302 is very troublesome. Particularly, when the cutting apparatus 5 is assembled to an apparatus, such as the printing apparatus 100, the replacement of the rotary blades 301 and 302 is very troublesome.

As described above, the output portion 209*a* of the carriage 200, which output torque, and the input portion 310*a* of the cutter unit 300 to which the torque is input have both a function to transmit torque to the lower rotary blade 302 and a function to position the cutter unit 300. Accordingly, the size of the carriage 200 and the size of the cutter unit 300 can be reduced. Particularly, since it is easy to handle the cutter unit 300 by the reduction of the size of the cutter unit 300, workability at the time of the replacement of the cutter unit 300 is significantly improved.

(Cutting Operation)

Figure 17:
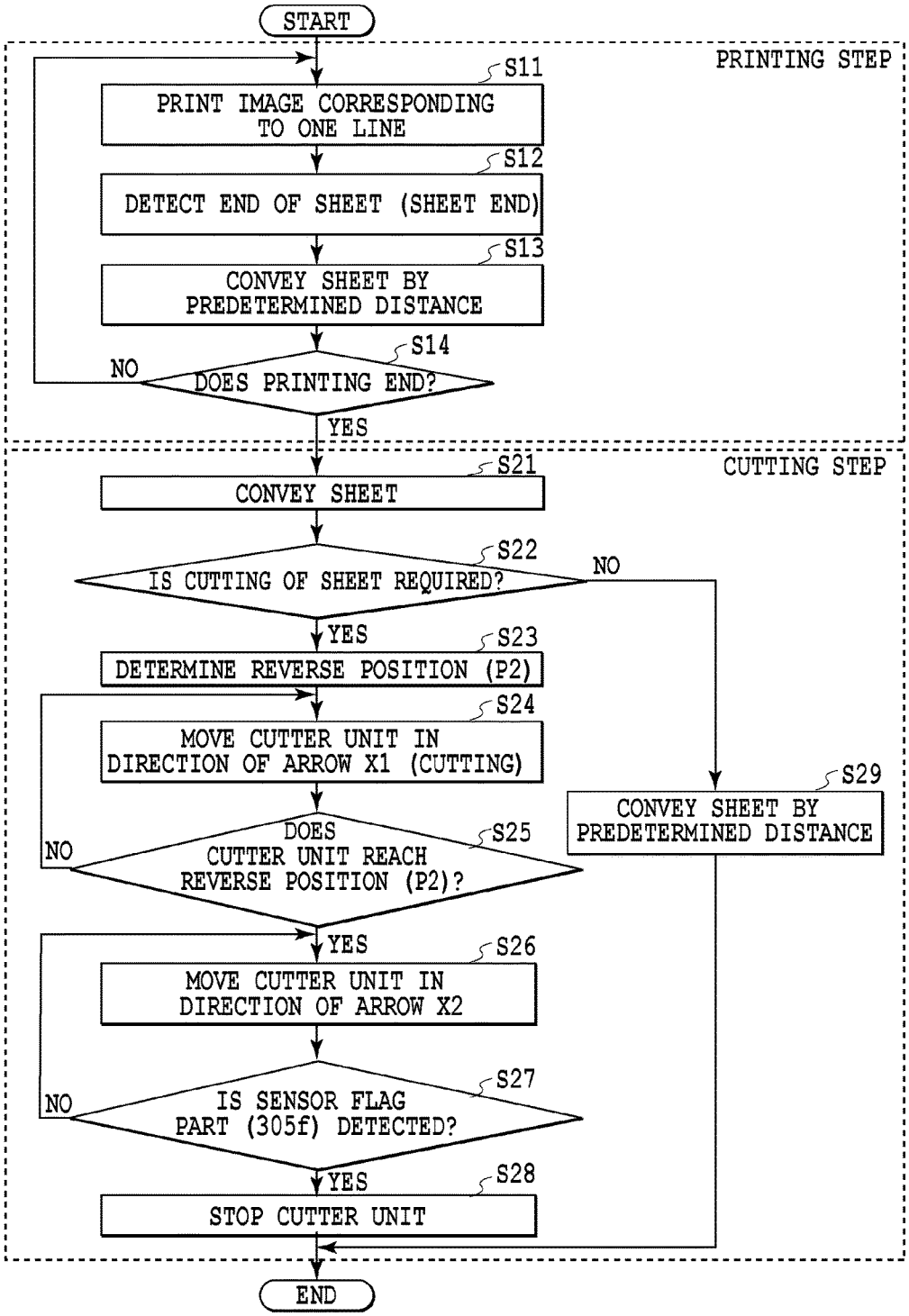
FIG. 17 is a flowchart illustrating an operation until the end of cutting from the start of printing.
Figure 18A:
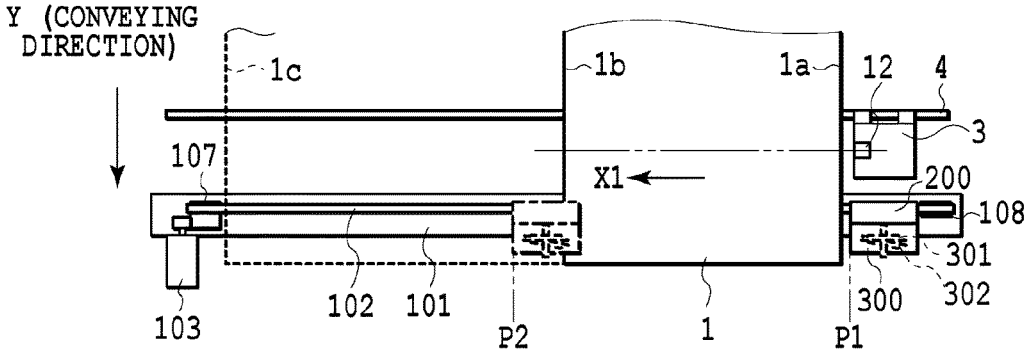
FIG. 18A, FIG. 18B, and FIG. 18C are diagrams illustrating a step of cutting a sheet.
Figure 18B:
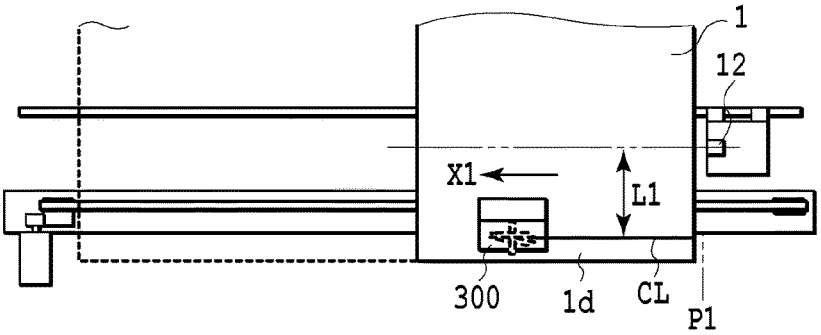
Figure 18C:
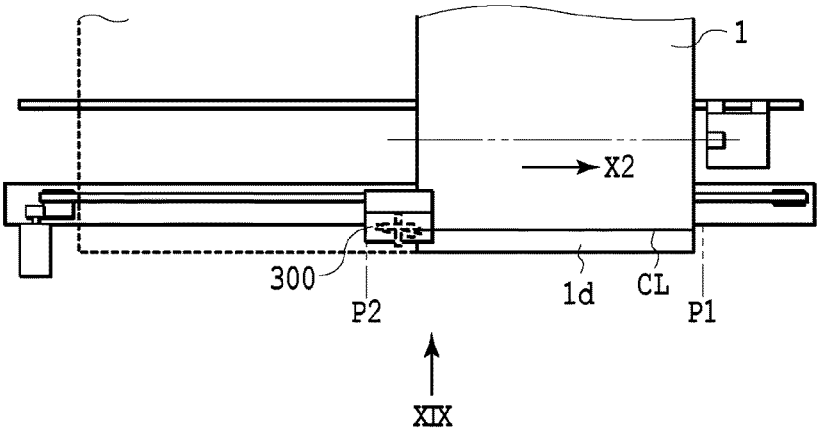
Figure 19A:
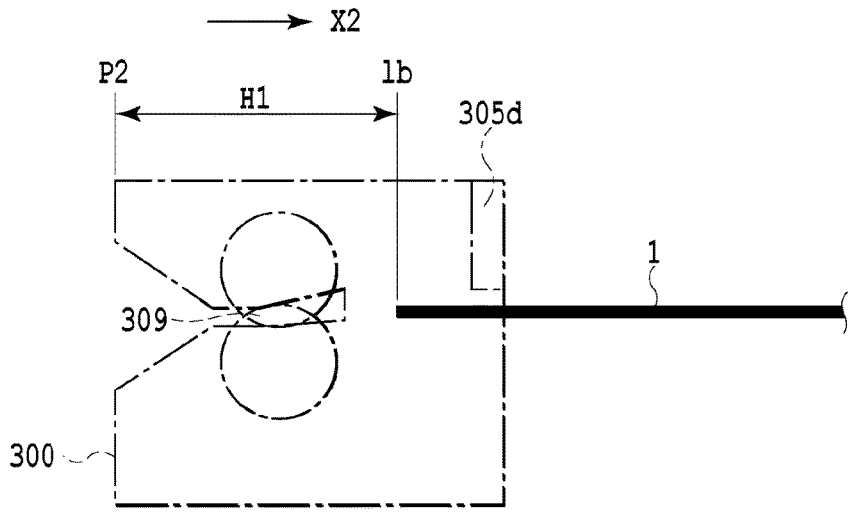
FIG. 19A and FIG. 19B are schematic diagrams illustrating the cutter unit that is viewed in the direction of an arrow XIX of FIG. 18C.
Figure 19B:
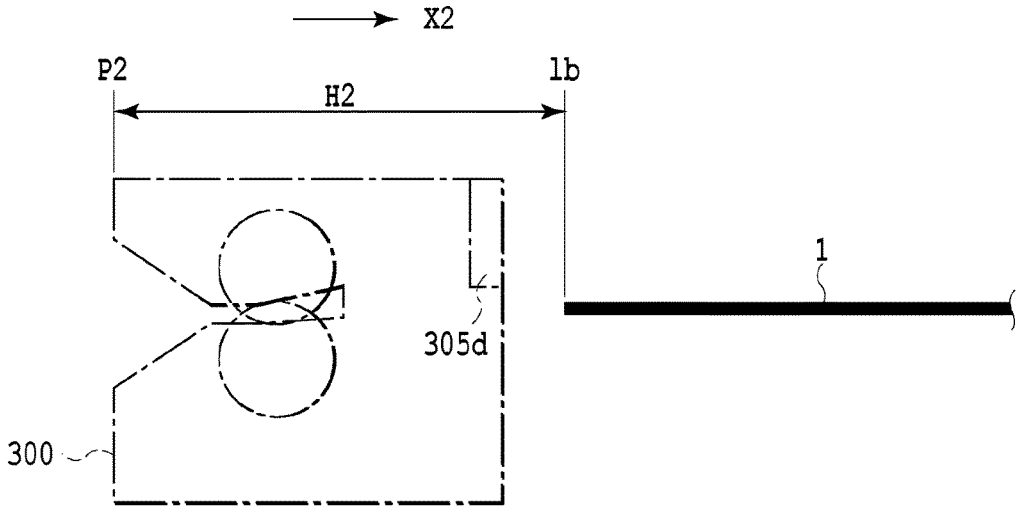

Next, a cutting operation will be described with reference to FIGS. 17 to 19B. FIG. 17 is a flowchart illustrating an operation until the end of cutting from the start of printing, and FIGS. 18A, 18B, and 18C are diagrams illustrating a step of cutting a narrow sheet into the shape of a strip. FIGS. 19A and 19B are schematic diagrams illustrating the cutter unit 300 in the cutting step of FIG. 18C that is viewed in the direction of an arrow XIX.

The flowchart of FIG. 17 is divided into a step of printing images on a sheet 1 (Steps S311 to S14) and a step of cutting the sheet 1 on which the images have been printed (Steps S21 to S28).

First, in the printing step, the printing head 2 moves forward or reverse together with the carriage 3 on the basis of operation signals and print jobs transmitted from the printing controller (see FIG. 2) 430 and prints an image corresponding to one line (Step S11). When the printing head 2 moves forward or reverse as described above, the positions of end portions (sheet ends) 1*a* and 1*b* of the sheet 1 are detected by the sheet end sensor (end portion position detector) 12 mounted on the carriage 3 (Step S12). That is, the sheet end sensor 12 moves in the moving direction of the cutter unit 300 together with the carriage 3 to detect the positions of the end portions 1*a* and 1*b* of the sheet 1. The end portion 1*a* is an end portion, which is close to the home position (a first end portion), of the sheet 1, and the end portion 1*b* is an end portion, which is close to a back position (the left side in FIG. 18A) (a second end portion), of the sheet 1. Then, after the sheet 1 is conveyed by a predetermined distance in the conveying direction (the direction of the arrow Y) (Step S13), the printing head 2 prepares for the printing of an image corresponding to the next one line. When print jobs, which are not yet performed, remain and printing has not ended, processing returns to Step S11 from Step S14 and processing performed between Steps S11 to S14 is repeated. When all print jobs have been performed, the sheet 1 is conveyed by a predetermined distance to a position at which the sheet 1 can be cut (Step S21) and processing proceeds to the next cutting step.

In the cutting step, it is determined whether or not the cutting of the sheet 1 is required (Step S22). If the cutting is not required, the sheet 1 is not cut and is conveyed by a predetermined distance in the direction of the arrow Y (Step S29) and the conveyance of the sheet 1 is stopped at a position where images printed on the sheet 1 can be visually recognized from the outside of the printing apparatus. Then, a series of the printing step and the cutting step ends.

On the other hand, if the cutting of the sheet 1 is required, the reverse position P2 where the cutter unit 300 is reversed and moved in the direction of the arrow X2 after the sheet 1 is cut with the movement of the cutter unit 300 in the direction of the arrow X1 is determined (Step S23). The reverse position P2 is calculated by adding a first auxiliary length H1 (FIG. 19A) or a second auxiliary length H2 (FIG. 19B) to the position of the end portion 1*b*, which is close to the back position and detected in Step S12, of the sheet 1 in the direction of the arrow X1. Each of the first and second auxiliary lengths H1 and H2 is an eigenvalue of the cutter unit 300. The first auxiliary length H1 is set to a value allowing the end portion 1*b*, which is close to the back position, of the sheet 1 to be positioned between the cutting point 309 and the push-out portion 305*d*, which pushes out the rear end of the cut sheet 1, at the time of the reverse of the cutter unit 300 as in FIG. 19A. The second auxiliary length H2 is set to a value allowing the end portion 1*b*, which is close to the back position, of the sheet 1 to deviate from push-out portion 305*d* at the time of the reverse of the cutter unit 300 as in FIG. 19B.

An auxiliary length, which is to be used to determine the reverse position P2, is selected from the auxiliary lengths H1 and H2 according to the width of a sheet (the cutting length). The shorter auxiliary length H1 is generally set, and cutting time can be minimized when this auxiliary length H1 is used. In a case in which the sheet needs to be protected depending on the kind of the sheet, the longer auxiliary length can be set to H2 so that a portion of the cut sheet does not come into contact with the cutter unit 300 when the cutter unit 300 having cut the sheet returns in the direction of the arrow X2. Moreover, when the sheet is a transparent film of which the end portions cannot be detected or when the end portions of the sheet are not detected on purpose, the maximum movement position of the cutter unit 300 in the direction of the arrow X1 can be determined as the reverse position P2. The maximum movement position may be, for example, a reverse position corresponding to an end portion 1*c*, which is close to the back position, of the largest sheet that can be cut. The reverse position P2 can be automatically determined on the basis of the kind of a sheet and the information about the position of the end portion. Further, a user can also selectively switch a desired reverse position P2 by the operation unit (not illustrated).

After the reverse position P2 is determined, the cutter unit 300 is moved from the stand-by position P1 in the direction of the arrow X1 as in FIGS. 18A and 18B (Step S23) to cut the sheet 1. The sheet 1 is cut along the movement locus of the cutting point 309 of the cutter unit 300 so that a cutting line CL is drawn. Since a relationship between the number of output pulses of the encoder 104 and the moving distance of the cutter unit 300 has been known in advance as described above, the moving distance and the current position of the cutter unit 300 are found out by the count of the number of output pulses of the encoder 104. Accordingly, the encoder 104 forms a movement position detector that detects the movement position of the cutter unit 300. When it is determined that the cutter unit 300 reaches the reverse position P2 as in FIG. 18C on the basis of the number of output pulses of the encoder 104, the cutter unit 300 is reversed and returns in the direction of the arrow X2 (Steps S25 and S26). After the sensor flag part (see FIG. 5) 305*f* of the cutter unit 300 is detected by the stand-by position sensor (see FIG. 3) 106, the encoder 104 outputs a predetermined number of pulses and the cutter unit 300 is then stopped (Steps S27 and S28). Accordingly, the cutter unit 300 is stopped at the stand-by position P1.

A position that is spaced apart from the end portion 1*b* of the sheet 1 on the outside of the sheet 1 by a predetermined distance, that is, a position that is spaced apart from the end portion 1*b* by the auxiliary length H1 or H2 is set as the reverse position P2 in this way, and the cutter unit 300 moves so as not to go over the reverse position P2.

The position of the cutter unit 300 is recognized by the count of the number of output pulses of the encoder 104 in this embodiment, but the position of the cutter unit 300 may be found out by other methods. For example, a pulse motor of which a motor shaft is rotated by an angle corresponding to the number of input pulses may be used as the cutter motor 103 and the position of the cutter unit 300 can be recognized on the basis of the number of the input pulses. Alternatively, a motor of which a motor shaft is rotated in proportion to time for which a predetermined voltage is applied may be used as the cutter motor 103, and the position of the cutter unit 300 can be recognized on the basis of the time for which the predetermined voltage is applied.

Further, in this embodiment, the reverse position P2 of the cutter unit 300 is determined on the basis of the position of the end portion of the sheet that is detected by the sheet end sensor 12 at the time of a printing operation (scan) performed immediately before the cutting operation. However, the reverse position P2 of the cutter unit 300 may be determined on the basis of the position of the end portion of the sheet that is detected by the sheet end sensor 12 at the time of a printing operation performed before several scans ahead of a printing operation, which is performed immediately before a cutting operation, that is, on the basis of information about the position of the end portion of the sheet of the past. For example, the reverse position P2 can be determined from a relationship between a distance L1 (FIG. 18B) and a conveying length L2. The distance L1 is a distance in the conveying direction, which is indicated by the arrow Y, between the detection position of the end portion of the sheet 1, which is detected by the sheet end sensor 12, and a cutting position present on the cutting line CL. The conveying length L2 is the length of the sheet 1 that is conveyed between the previous printing operation and the next printing operation. For example, when the distance L1 is 50 mm and the conveying length L2 is 10 mm, the position of the end portion of the sheet, which is used at the time of the current cutting operation, is the position of the end portion of the sheet that was detected before the last five printing operations. Accordingly, the reverse position P2 can be more accurately determined on the basis of the position of the end portion of the sheet at the cutting position of the sheet 1. Furthermore, in this embodiment, the end portion of the sheet is detected at the time of the printing operation by the sheet end sensor 12 mounted on the carriage 3 of the printing head 2. However, a method of detecting the end portion of the sheet is arbitrary without being limited to the structure of this embodiment. In short, the end portion of the sheet 1 has only to be detected.

As described above, in this embodiment, the reverse position P2 of the cutter unit 300 is determined on the basis of information about the position of the end portion of the sheet that is detected at the time of the printing operation performed immediately before the cutting operation or at the time of a printing operation performed before the printing operation performed immediately before the cutting operation. When the sheet 1 is cut up to the reverse position P2, the sheet 1 can be cut at a position that is set in consideration of the skew of the sheet 1 occurring during the conveyance of the sheet 1, the influence of the expansion of the sheet 1 caused by changes in temperature and humidity, and the like. Accordingly, the sheet 1 can be cut in the shortest time without the cutting failure of the sheet 1.

(Behavior of Cut Piece of Sheet)

FIGS. 20 to 23 are diagrams illustrating the behavior of a cut piece (a strip-shaped sheet piece) 1*d* when a sheet 1 is cut into a short length.

Figure 20:
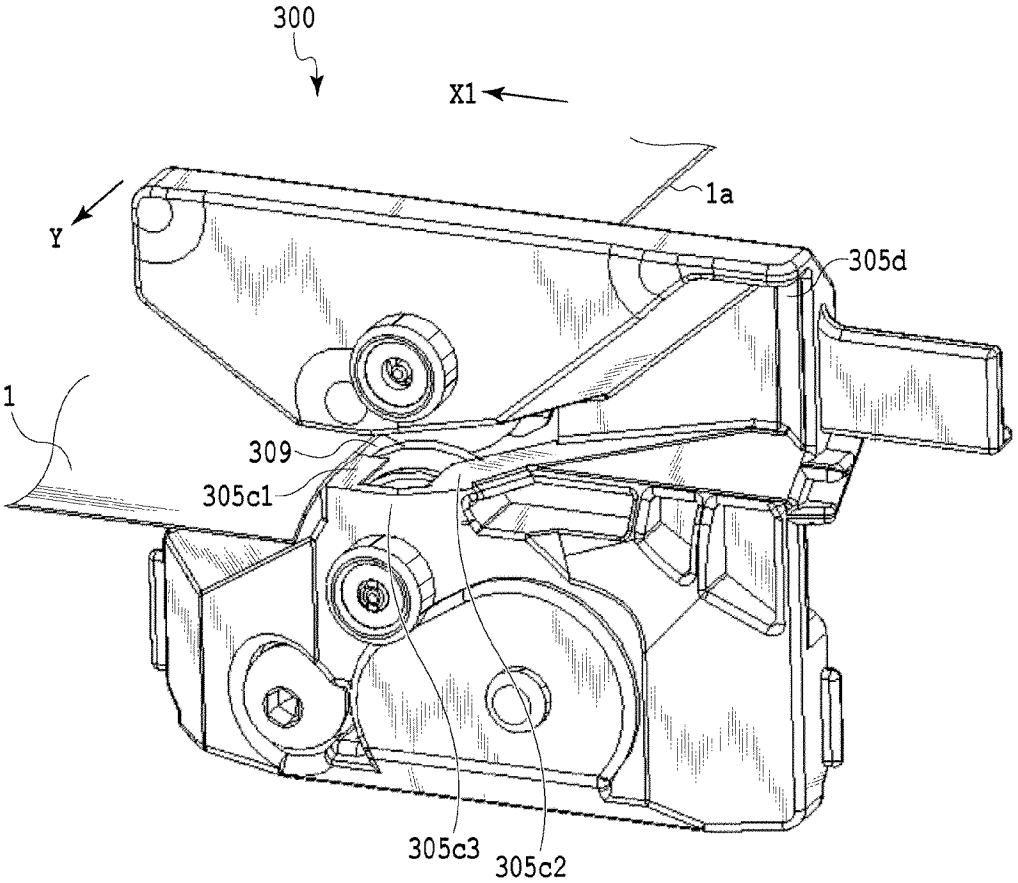
FIG. 20 is a perspective view of the cutter unit at the time of the start of the cutting of a sheet.

FIG. 20 is a perspective view of the cutter unit 300 at the time of the start of the cutting of the sheet 1. The cutter unit 300 is provided with the support portions 305*c*1 and 305*c*2 and the push-out portion 305*d* as described above. A support surface (a first support surface), which supports the back of the sheet 1, is provided on the support portion 305*c*1 substantially in parallel to the surface of the sheet 1. A support surface (a second support surface), which supports the back of the sheet, is formed on the support portion 305*c*2 so as to extend in the conveying direction that is indicated by the arrow Y, and the support surface of the support portion 305*c*2 is inclined so as to raise the sheet 1 as in FIG. 20. The push-out portion 305*d* pushes the cut piece 1*d* to the downstream side in the conveying direction (the direction of the arrow Y) to make the cut piece 1*d* easily be discharged. The support surface of the support portion 305*c*1 and the inclined support surface of the support portion 305*c*2 are formed so as to continue to each other, and an intersection 305*c*3 between these support surfaces is positioned on the downstream side of the cutting point 309 in the cutting direction (the direction of the arrow X1). The support surface of the support portion 305*c*1 and the support surface of the support portion 305*c*2 may not continue to each other, and the extension planes of these support surfaces have only to cross each other at the intersection 305*c*3 in this case.

Figure 21A:
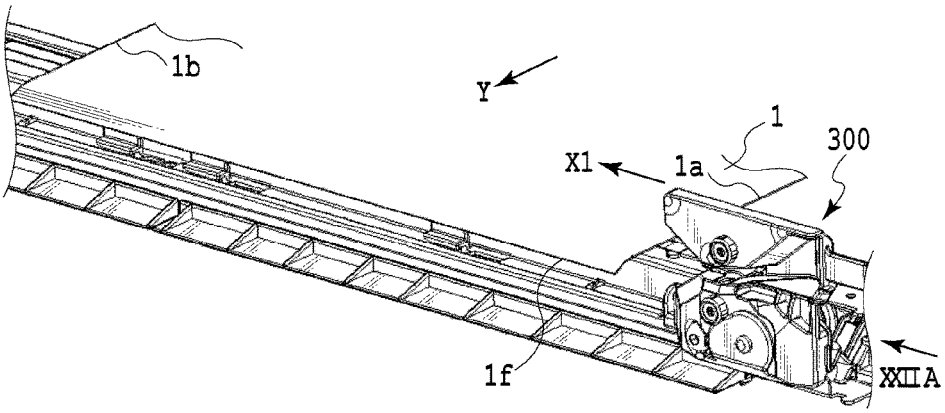
FIG. 21A, FIG. 21B, and FIG. 21C are perspective views of main parts illustrating the behavior of a cut piece of a sheet.
Figure 21B:
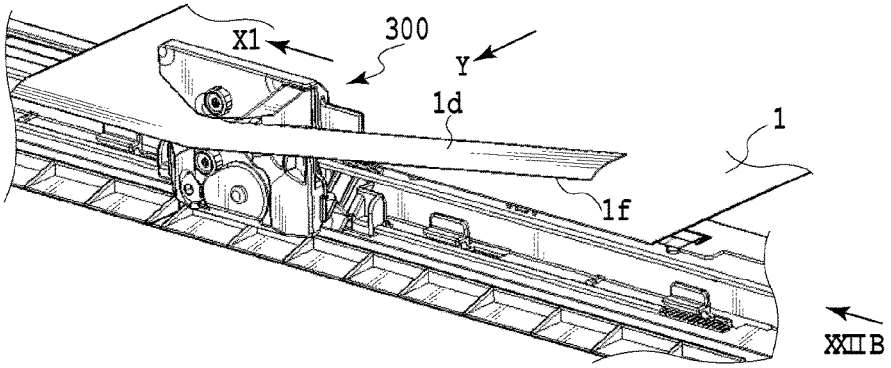
Figure 21C:
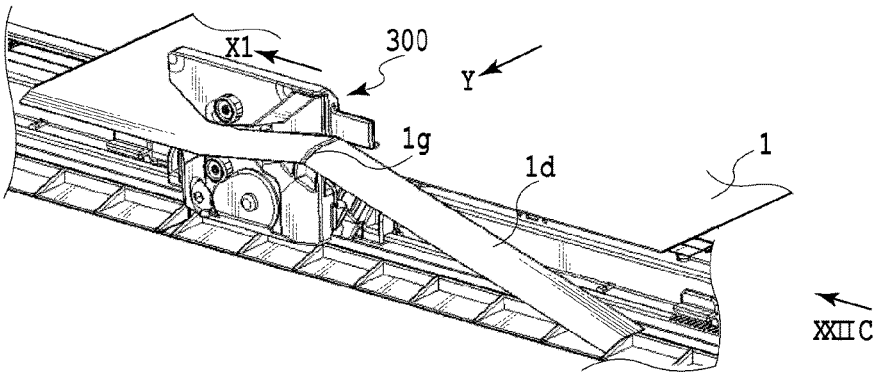
Figure 22A:
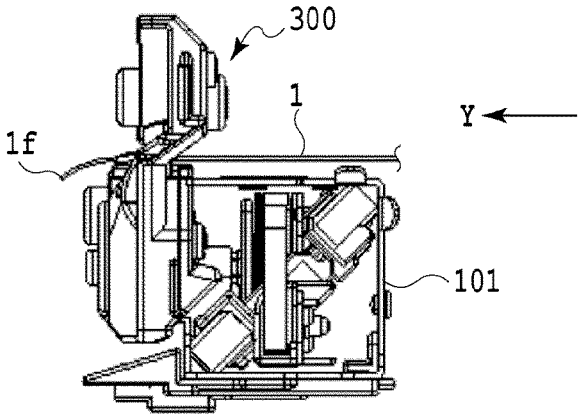
FIG. 22A, FIG. 22B, and FIG. 22C are side views of main parts illustrating the behavior of a cut piece of a sheet.
Figure 22B:
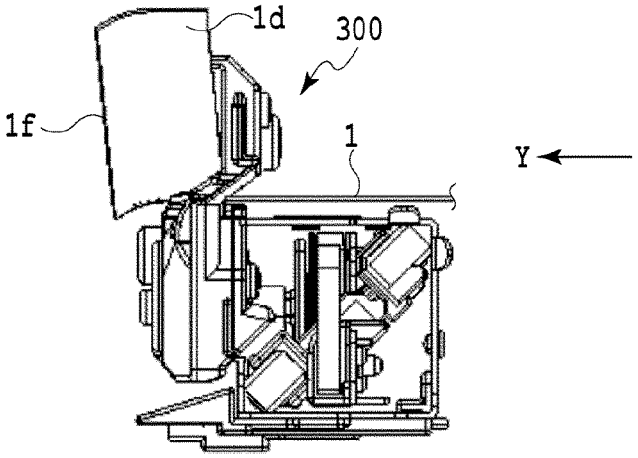
Figure 22C:
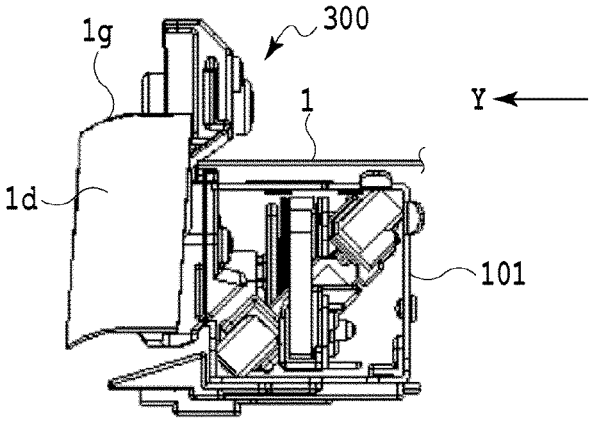
Figure 23:
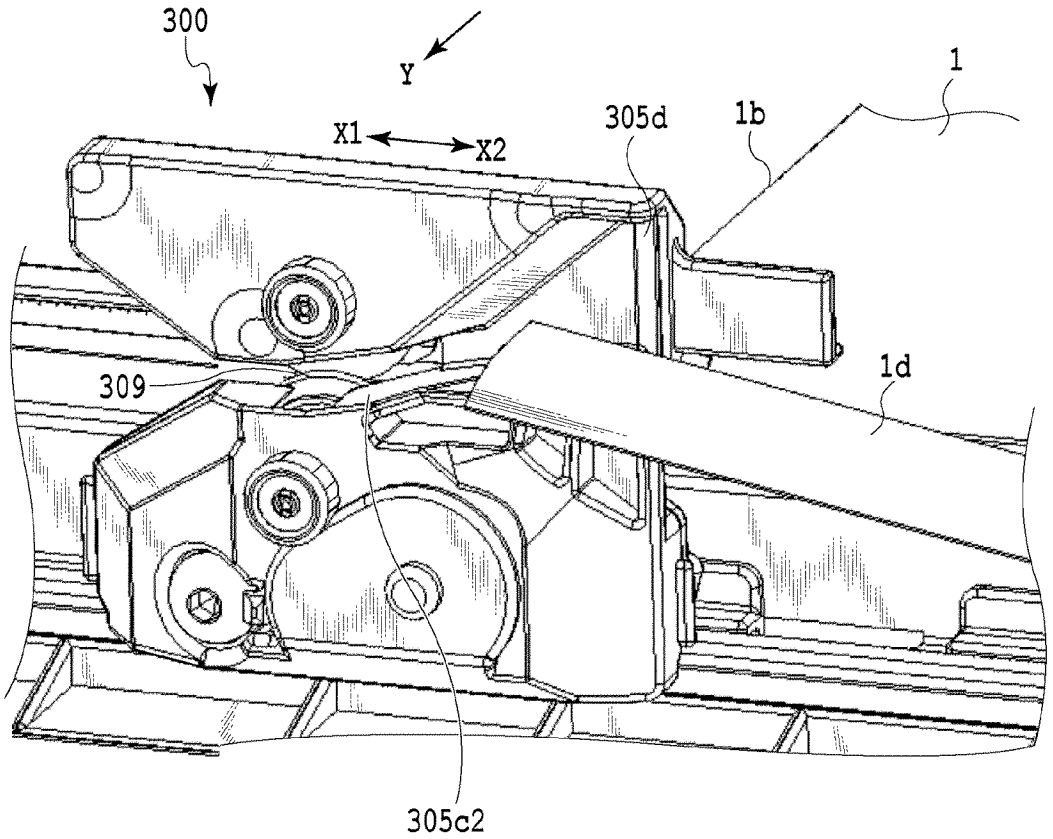
FIG. 23 is a perspective view of the cutter unit at the time of the end of the cutting of a sheet.

FIGS. 21A to 22C are diagrams illustrating the behavior of the cut piece 1*d* when the sheet 1 is cut by the cutter unit 300. FIG. 21A illustrates a state in which the sheet 1 is not yet cut, FIG. 21B illustrates a state in which a part of the cut piece 1*d* is separated from the sheet 1 and the sheet 1 is being cut. FIG. 21C illustrates a state in which the cutting of the cut piece 1*d* slightly progresses from the state of FIG. 21B, the cut piece 1*d* is folded due to its own weight, and the sheet 1 is being cut. FIG. 22A is a side view of the cutter unit 300 and the sheet 1 of FIG. 21A that is viewed in the direction of an arrow XXIIA, FIG. 22B is a side view of the cutter unit 300 and the sheet 1 of FIG. 21B that is viewed in the direction of an arrow XXIIB, and FIG. 22C is a side view of the cutter unit 300 and the sheet 1 of FIG. 21C that is viewed in the direction of an arrow XXIIC. FIG. 23 illustrates a state in which the sheet 1 has been completely cut by the cutter unit 300.

Since the support portions 305*c*1 and 305*c*2 of the cutter unit 300 support the back of the cut piece 1*d*, the behavior of the cut piece 1*d*, which is caused by the winding of the sheet 1, is suppressed before and after the cutting of the sheet 1 and the cut piece 1*d* is stabilized. As the cutter unit 300 moves in the direction of the arrow X1, the cut piece 1*d* is gradually separated from the sheet after the cutting point 309 passes through the end portion 1*a*, which is close to the home position, of the sheet 1. Since the cut piece 1*d* is guided to the support portion 305*c*2 after passing through the intersection 305*c*3 of the cutter unit 300, the cut piece 1*d* is raised while the winding of a tip 1*f* of the sheet 1 remains a little bit (FIGS. 21B and 22B). Since the support portion 305*c*2 supports the back of the cut piece 1*d*, the winding of the cut piece 1*d* is suppressed but the winding of the cut piece 1*d* remains a little bit. For this reason, the cut piece 1*d* is not folded until the cut piece 1*d* is cut into a certain length.

In addition, when the cutting of the cut piece 1*d* progresses, the weight of the cut piece 1*d* is increased and the cut piece 1*d* is bent at a portion (a bent portion) 1*g* thereof positioned near an end portion of the support portion 305*c*2 where bending stress is maximum as in FIGS. 21C and 22C. Since the winding of the tip 1*f* of the cut piece 1*d* remains a little bit but the cross-section of the cut piece 1*d* is substantially horizontal, the cut piece 1*d* hangs down substantially immediately below due to bending and does not enter the guide rail 101.

When the cutting of the cut piece 1*d* ends after further progressing, the cutter unit 300 stops at the reverse position, for example, the reverse position where the end portion 1*b* of the sheet 1 close to the back position is positioned between the cutting point 309 and the push-out portion 305*d*. At this time, the cut piece 1*d* is pushed to the downstream side in the conveying direction by the push-out portion 305*d* of the cutter unit 300. Accordingly, the cut piece 1*d* falls onto the sheet discharge guide without being caught on the end portion of the support portion 305*c*2, and the discharge of the cut piece 1*d* is completed.

Under a certain kind of a sheet or under a certain printing condition (printing density or the like) of an image, there is a concern that the cut piece 1*d* may be caught on the end portion of the support portion 305*c*2 as in FIG. 23. When the cutter unit 300 is moved in the direction of the arrow X2 and returns to the stand-by position in this state, there is a concern that the cut piece 1*d* may pass through the cutting point 309 again and may be cut again (cut twice). However, in this embodiment, since the cut piece 1*d* is pushed to the downstream side in the conveying direction by the push-out portion 305*d* when the cutting of the cut piece 1*d* ends. Accordingly, the cut piece 1*d* deviates from the cutting point 309. As a result, when the cutter unit 300 returns to the stand-by position, the occurrence of the cutting failure in which the cut piece 1*d* is cut again can be suppressed.

Since the cutter unit 300 is provided with the substantially flat support portions 305*c*1 and 305*c*2 that support the back of the cut piece 1*d* and the push-out portion 305*d* that pushes out the cut piece 1*d* in this embodiment as described above, the behavior of the cut piece 1*d* can be stabilized. Accordingly, even when a short cut piece 1*d* is cut from a sheet 1, the occurrence of the cutting failure can be suppressed and the cut piece 1*d* can be normally discharged. The support portion 305*c*2 has only to be capable of supporting the back of the cut piece 1*d*, and is not limited to only the surface that is inclined upward as described above. For example, the support portion 305*c*2 may form the same horizontal surface as the support portion 305*c*1 or may form the surface that is inclined downward. Even in this case, the same effect can be obtained.

Comparative Example

In order to suppress the occurrence of the cutting failure during the cutting of a short cut piece 1*d* as described above, it is important that the support portions 305*c*1 and 305*c*2 function. The behavior of the cut piece 1*d* in a case in which a cutter unit 320 not provided with the support portions 305*c*1 and 305*c*2 is used will be described below as a comparative example.

Figure 24:
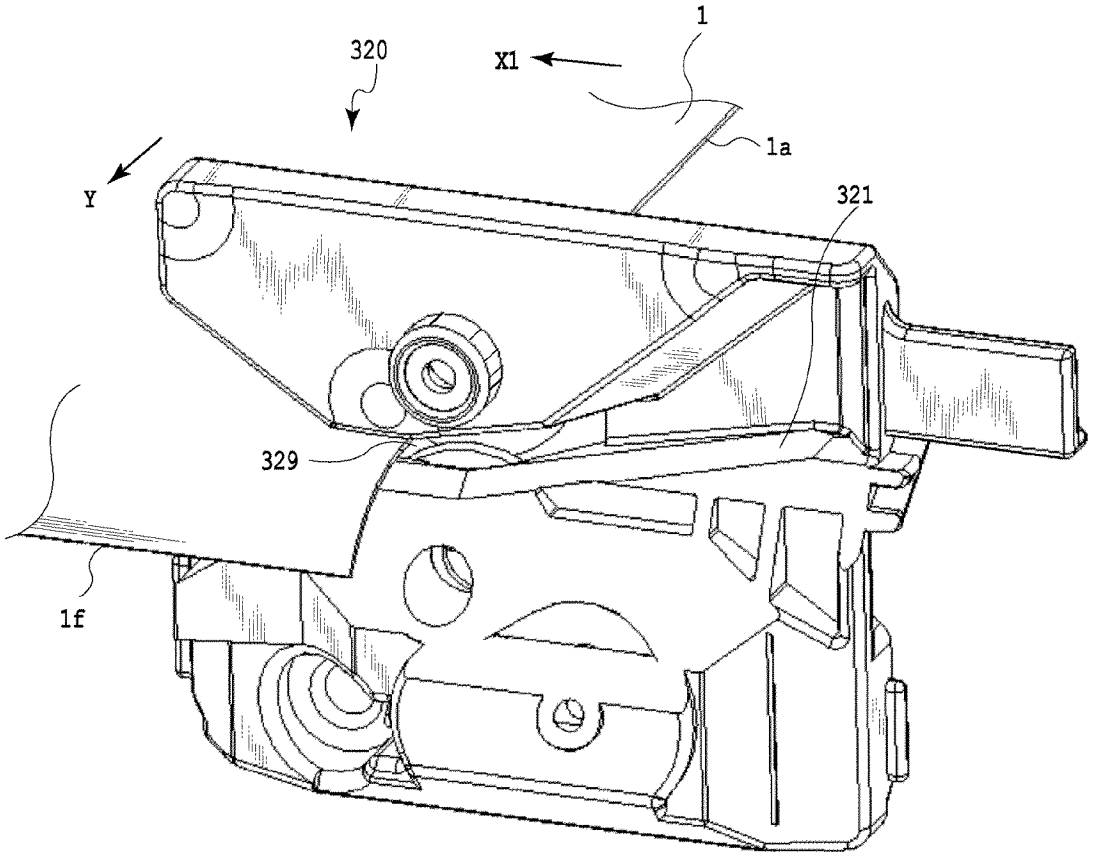
FIG. 24 is a perspective view of a cutter unit of a comparative example.

FIG. 24 is a perspective view of a cutter unit 320 at the time of the start of the cutting of the sheet 1. Since the cutter unit 320 is not provided with support portions, such as the support portions 305*c*1 and 305*c*2, supporting the back of the cut piece 1*d*, the winding of the sheet 1 cannot be suppressed and winding is strong near the tip 1*f*.

Figure 25A:
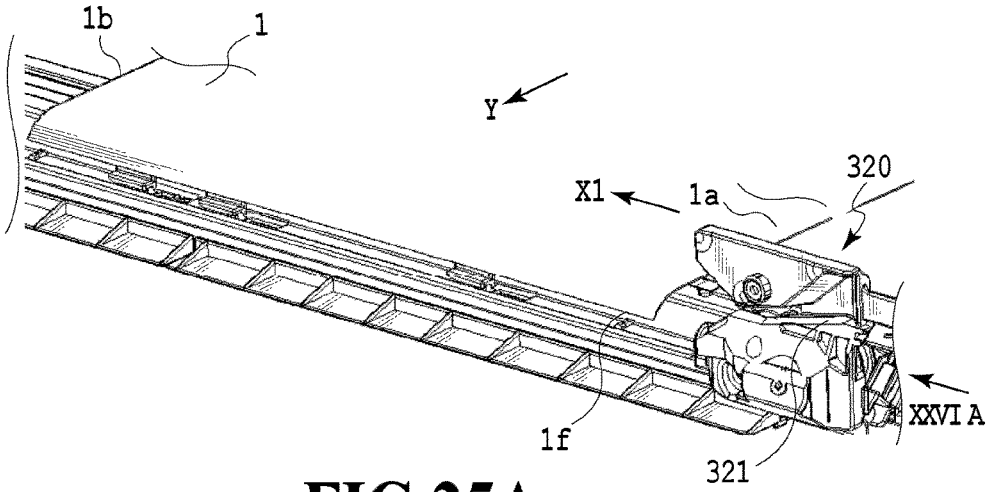
FIG. 25A, FIG. 25B, and FIG. 25C are perspective views of main parts illustrating the behavior of a cut piece of a sheet that is cut by the cutter unit of the comparative example.
Figure 25B:
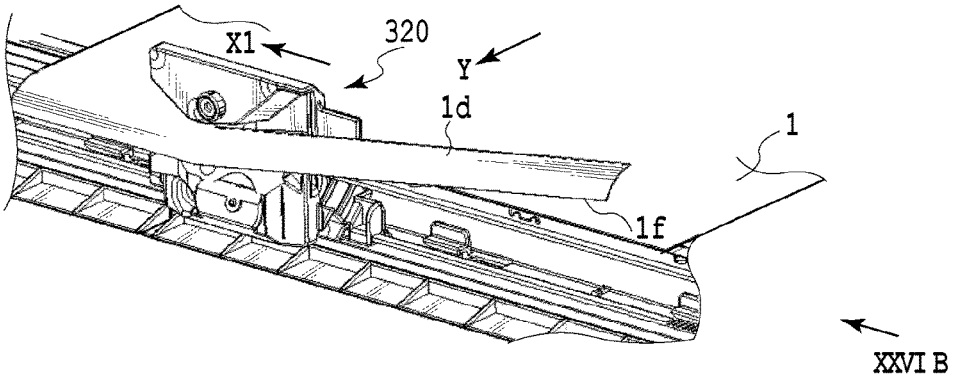
Figure 25C:
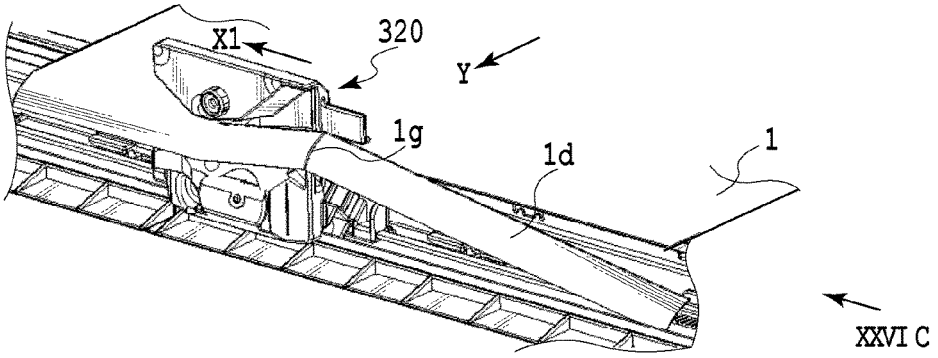
Figure 26A:
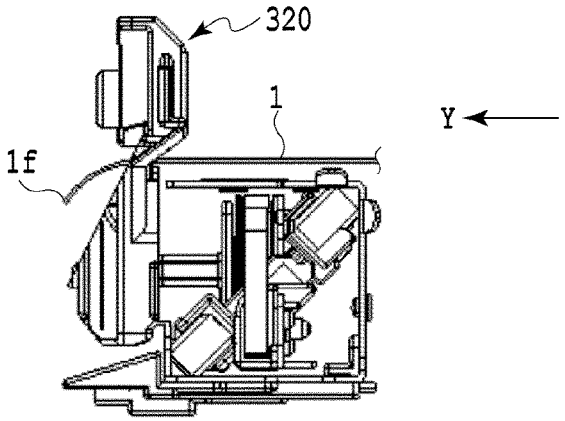
FIG. 26A, FIG. 26B, and FIG. 26C are side views of main parts illustrating the behavior of a cut piece of a sheet that is cut by the cutter unit of the comparative example.
Figure 26B:
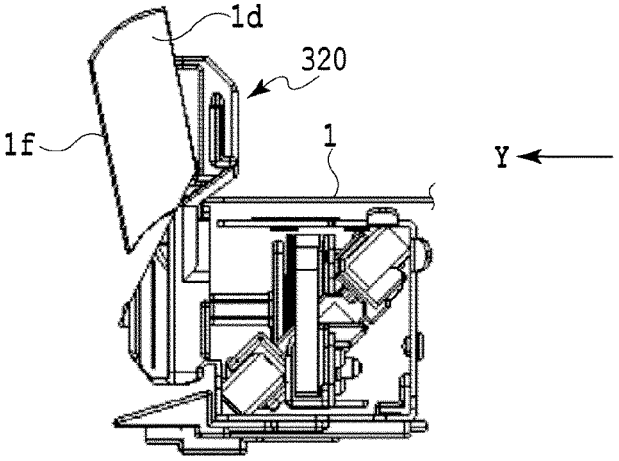
Figure 26C:
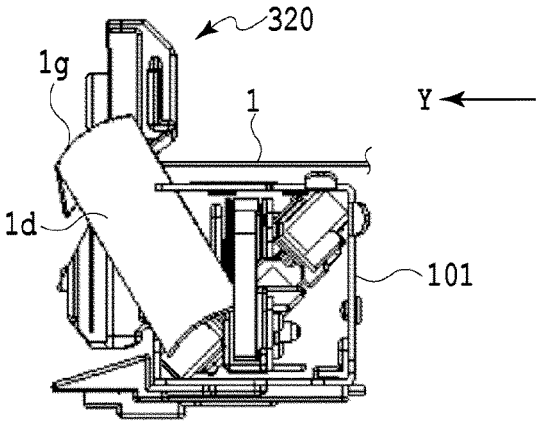

FIGS. 25A to 26C are diagrams illustrating the behavior of the cut piece 1*d* when the sheet 1 is cut by the cutter unit 320. FIG. 25A illustrates a state in which the sheet 1 is not yet cut, FIG. 25B illustrates a state in which a part of the cut piece 1*d* is separated from the sheet 1 and the sheet 1 is being cut. FIG. 25C illustrates a state in which the cutting of the cut piece 1*d* slightly progresses from the state of FIG. 25B, the cut piece 1*d* is folded due to its own weight, and the sheet 1 is being cut. FIG. 26A is a side view of the cutter unit 320 and the sheet 1 of FIG. 25A that is viewed in the direction of an arrow XXVIA, FIG. 26B is a side view of the cutter unit 320 and the sheet 1 of FIG. 25B that is viewed in the direction of an arrow XXVIB, and FIG. 26C is a side view of the cutter unit 320 and the sheet 1 of FIG. 25C that is viewed in the direction of an arrow XXVIC.

As the cutter unit 320 moves in the direction of the arrow X1, the cut piece 1*d* is gradually separated from the sheet 1 after the cutting point 309 passes through the end portion 1*a*, which is close to the home position, of the sheet 1. Since the cut piece 1*d* is guided by an inclined surface of an inclined portion 321, the cut piece 1*d* is raised while the winding of the tip 1*f* of the sheet 1 remains (FIGS. 25B and 26B). Since the winding of the cut piece 1*d* remains, the cut piece 1*d* is not folded until the cut piece 1*d* is cut into a certain length.

In addition, when the cutting of the cut piece 1*d* progresses, the weight of the cut piece 1*d* is increased and the cut piece 1*d* is bent at a portion (a bent portion) 1*g* thereof positioned near an end portion of the inclined portion 321 where bending stress is maximum as in FIGS. 25C and 26C. Since the winding of the tip 1*f* of the cut piece 1*d* remains a little bit but the cross-section of the cut piece 1*d* is substantially horizontal, the cut piece 1*d* does not hang down substantially immediately below due to bending and is likely to easily enter the guide rail 101. Since strong winding, which allows the tip 1*f* to hang down, remains on the cut piece 1*d*, the cut piece 1*d* hangs down in an oblique direction in which the cut piece 1*d* is likely to be bent without hanging down immediately below when being bent. For this reason, the cut piece 1*d* is likely to enter the guide rail 101.

Since the cutter unit 320 does not include a surface, which supports the sheet 1 from the back, near the cutting point 309 as described above, the cut piece 1*d* is likely to enter the guide rail 101. For this reason, when the cutter unit 320 returns, the cutting failure in which the cut piece 1*d* is cut again is likely to occur.

Second Embodiment

In the above-mentioned first embodiment, the reverse position P2 of the cutter unit 300 has been determined on the basis of information about the position of the end portion 1*b*, which is close to the back position and detected by the sheet end sensor 12, of the sheet 1. Information about the position of the end portion 1*a*, which is close to the home position, of the sheet 1 is further considered in the second embodiment. In the second embodiment, the same components as those of the first embodiment will be denoted by the same reference numerals and the description thereof will be omitted.

Figures 27, 27A:
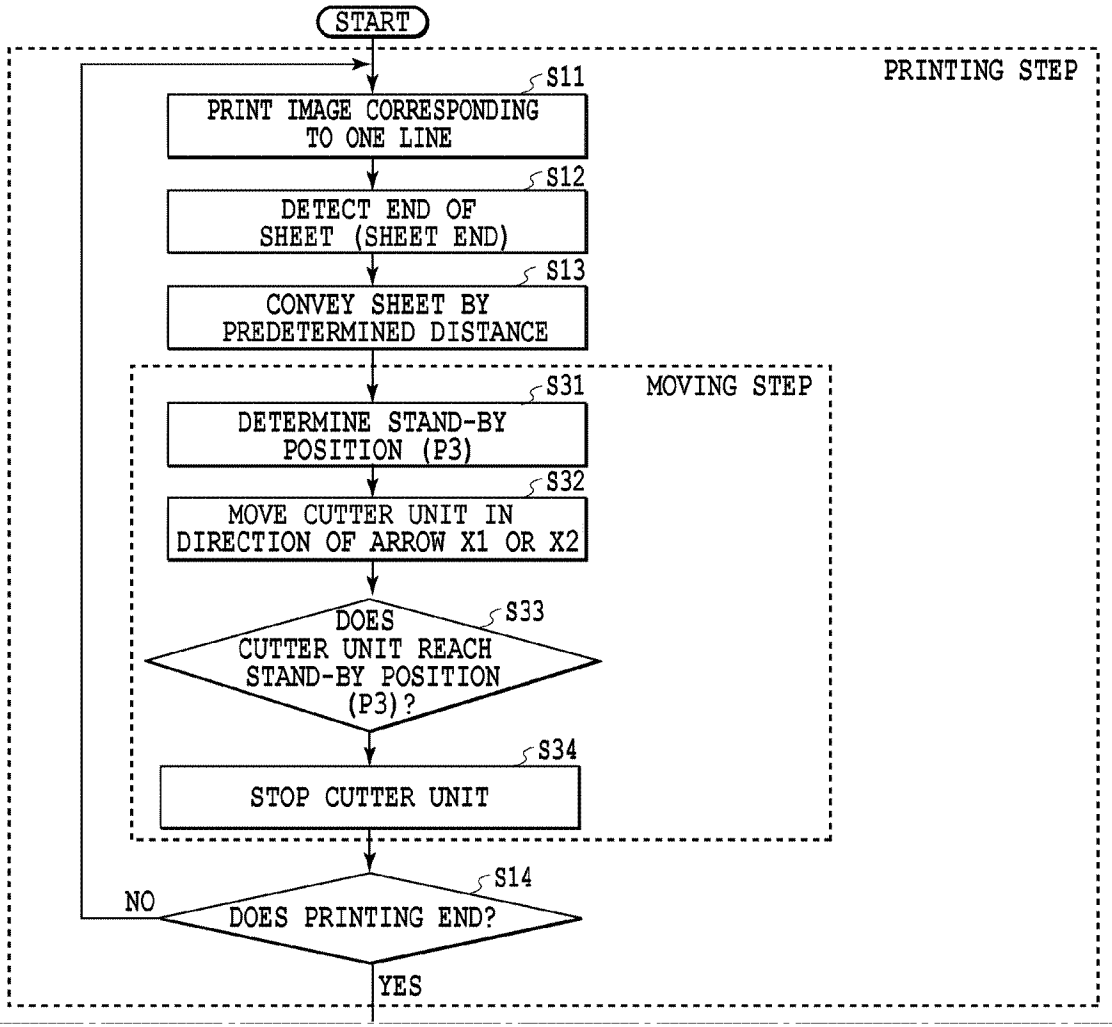
FIG. 27 is a diagram showing the relationship of FIGS. 27A and 27B.
FIG. 27A and FIG. 27B are flowcharts illustrating an operation until the end of cutting from the start of printing in another embodiment of the invention.
Figure 27B:
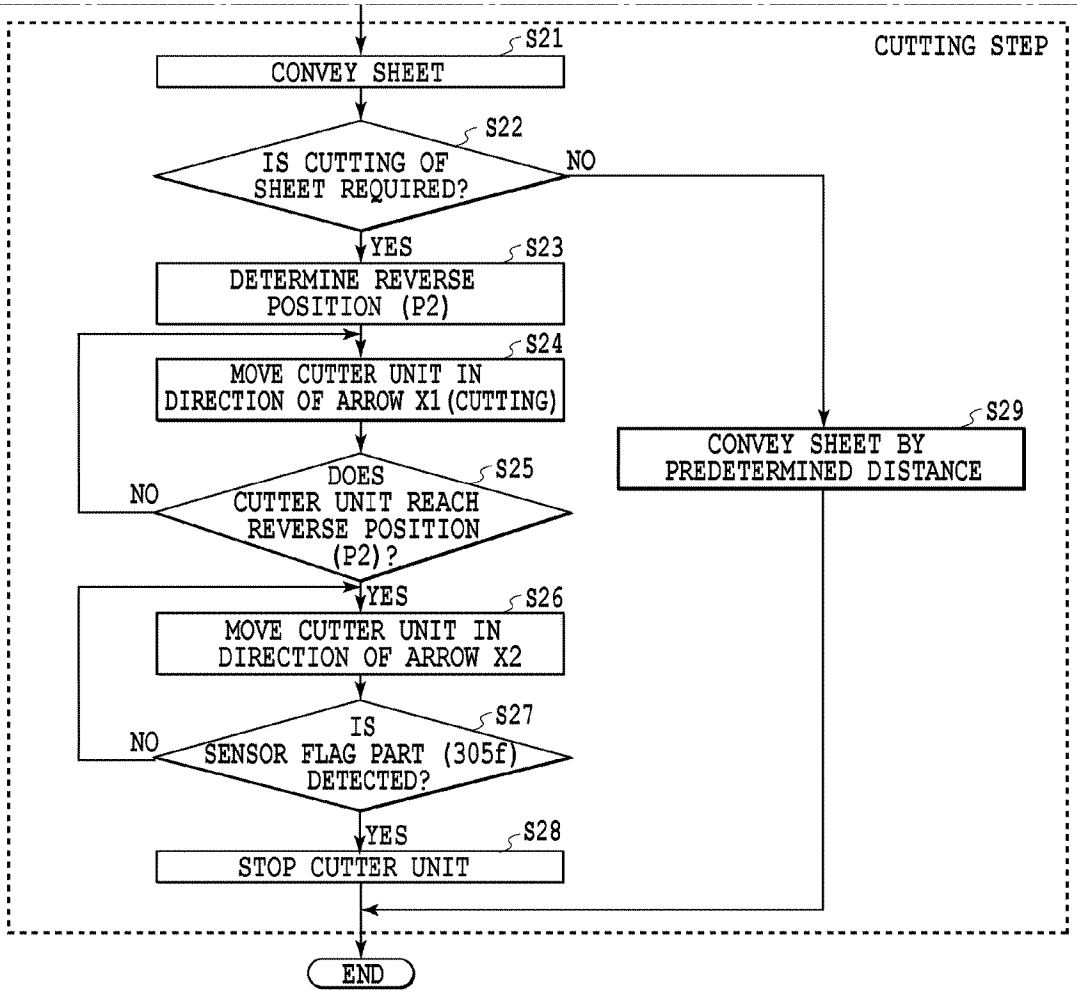

A cutting operation of the second embodiment will be described with reference to FIGS. 27 to 29. FIG. 27 is a flowchart illustrating an operation until the end of cutting from the start of printing, and FIGS. 28A, 28B, and 28C are diagrams illustrating a step of cutting a narrow sheet into the shape of a strip. FIG. 29 is a schematic diagram illustrating the cutter unit 300 at the time of the start of cutting from a stand-by position P3 to be described below, which is viewed in the direction of an arrow XXIX of FIG. 28A.

The flowchart of FIG. 27 is divided into a step of printing images on a sheet 1 and a step of cutting the sheet 1 on which the images have been printed. The flowchart of FIG. 27 is different from the flowchart of FIG. 17 of the above-mentioned embodiment in that a moving step (Steps S31 to S34) is added to the printing step (Steps S11 to S14). The moving step is a step of moving the cutter unit 300 to the stand-by position P3, which is separate from the stand-by position P1, before the cutting step (Steps S21 to S28). In this embodiment, the moving step is added to the printing step and is performed after the sheet is conveyed by a predetermined distance in Step S13. However, the invention is not limited thereto, and the moving step may be performed at the same time with the conveyance of the sheet 1 by a predetermined distance in Step S13 or may be performed before the cutting step.

In the moving step, the stand-by position P3 of the cutter unit 300 is determined first (Step S31). The stand-by position P3 is calculated by subtracting a stand-by auxiliary length H3 from the position of the end portion 1*a*, which is close to the home position and detected in Step S12, of the sheet 1 in the direction of an arrow X1 as in FIG. 29. The value of the auxiliary length H3 is an eigenvalue of the cutter unit 300, and it is preferable that the auxiliary length H3 is as small as possible so that the sheet 1 does not interfere with the cutter unit in an operation for conveying the sheet 1.

Figure 28A:
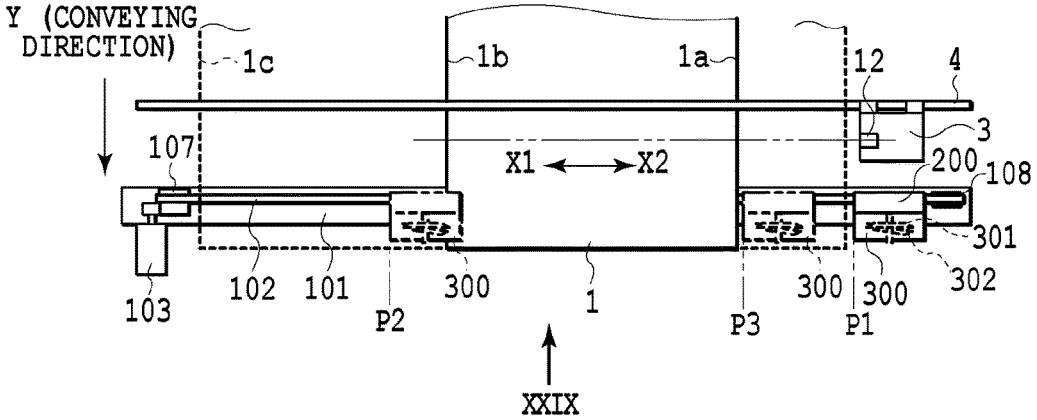
FIG. 28A, FIG. 28B, and FIG. 28C are diagrams illustrating a step of cutting a sheet in FIG. 27.
Figure 28B:
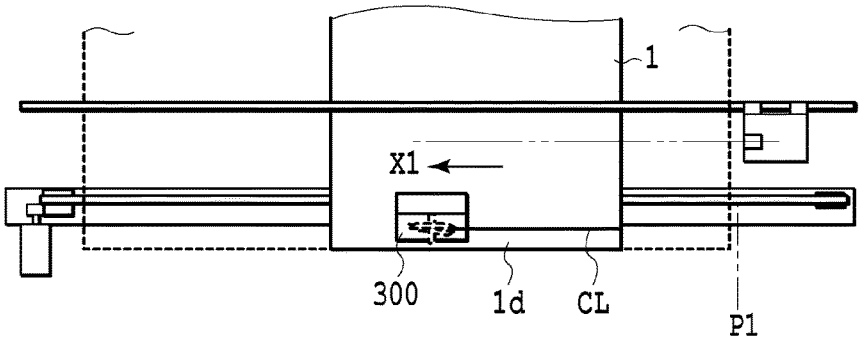
Figure 28C:
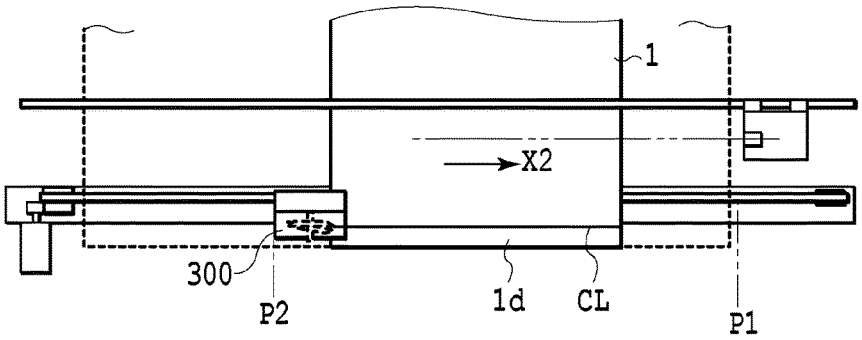
Figure 29:
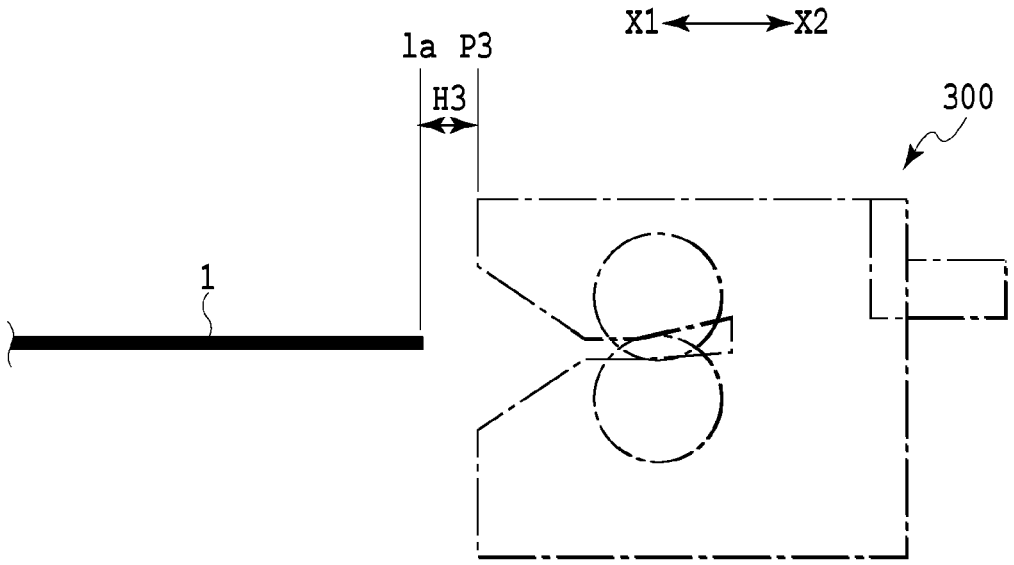
FIG. 29 is a schematic diagram illustrating a cutter unit that is viewed in the direction of an arrow XXIX of FIG. 28A.

After the stand-by position P3 is determined, the cutter unit 300 is moved in the direction of the arrow X1 or X2 as in FIG. 28A so as to be positioned at the stand-by position P3 (Step S32). When the cutter unit 300 reaches the stand-by position P3 as in FIG. 28A, processing proceeds to Step S14 after the cutter unit 300 is stopped (Steps S33 and S34). When print jobs, which are not yet performed, remain and printing has not ended, processing returns to Step S11 from Step S14 and processing performed between Steps S11 to S14 is repeated. That is, the determination of the stand-by position P3 and the movement of the cutter unit 300 to the stand-by position P3 (Steps S31 to S34) are performed again after the printing of an image corresponding to one line, the detection of the end portion of the sheet, and the conveyance of the sheet 1 by a predetermined distance (Steps S11 to S13).

In this embodiment, the movement of the cutter unit 300 to the stand-by position P3 is performed whenever the end portion of the sheet is detected (Step S12) until the printing operation ends. However, the cutter unit 300 may be moved to the stand-by position P3 whenever the end portion of the sheet is detected several times. Further, the cutter unit 300 may be moved to the stand-by position P3 when a difference between a current detection position of the end portion of the sheet and a previous detection position of the end portion of the sheet exceeds a predetermined value.

When all print jobs have been performed, processing proceeds to the next cutting step after the sheet 1 is conveyed by the predetermined distance to the position at which the sheet 1 can be cut (Step S21).

In the cutting step, it is determined whether or not the cutting of the sheet 1 is required (Step S22). If the cutting of the sheet 1 is required, the reverse position P2 is determined in the same manner as the case of the above-mentioned first embodiment (Steps S22 and S23). After the reverse position P2 is determined, the cutter unit 300 is moved from the stand-by position P1 in the direction of the arrow X1 as in FIG. 28B (Step S23) to cut the sheet 1. The sheet 1 is cut along the movement locus of the cutting point 309 of the cutter unit 300 so that the cutting line CL is drawn. As in the case of the above-mentioned first embodiment, it is determined whether or not the cutter unit 300 reaches the reverse position P2 as in FIG. 28C on the basis of the number of output pulses of the encoder 104 (Step S25). If the cutter unit 300 reaches the reverse position P2, the cutter unit 300 is reversed and returns in the direction of the arrow X2 (Step S26). Then, after the sensor flag part (see FIG. 5) 305*f* of the cutter unit 300 is detected by the stand-by position sensor (see FIG. 3) 106, the encoder 104 outputs a predetermined number of pulses and the cutter unit 300 is then stopped (Steps S27 and S28). Accordingly, the cutter unit 300 is stopped at the stand-by position P1 and a series of the printing step and the cutting step ends.

In this embodiment, the stand-by position P3 and the reverse position P2 of the cutter unit 300 are determined as described above on the basis of information about the position of the end portion of the sheet that is detected by the sheet end sensor 12 mounted on the carriage 3. Accordingly, the sheet 1 can be cut at a position that is set in consideration of the skew of the sheet 1 occurring during the conveyance of the sheet 1, the influence of the expansion of the sheet 1 caused by changes in temperature and humidity, and the like. Accordingly, the sheet 1 can be cut in the shortest time without the cutting failure of the sheet 1.

Other Embodiments

The structure of blades of a cutting apparatus for cutting a sheet is not limited to the structure that uses two rotary blades, and the cutting apparatus has only to be capable of cutting a sheet with the relative movement of itself and the sheet. For example, the cutting apparatus may use a movable blade that moves up and down, a stationary blade, and a combination of a movable blade and a stationary blade, and the number of blades may be one. Further, the cutting apparatus may be assembled to various apparatuses that handle sheets other than the printing apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-189989 filed Sep. 28, 2015, which is hereby incorporated by reference herein in its entirety.

What is claimed is:

1. A cutting apparatus comprising:

a cutter unit having a cutter blade, the cutter unit being configured to reciprocate with the cutter blade from a first end portion of a sheet through a second end portion of the sheet to cut the sheet;

a sensing unit configured to sense a position of at least the second end portion of the sheet; and a control unit configured to control movement of the cutter unit such that a return movement of the cutter unit occurs from a reverse position that is set in accordance with a sensing result of the sensing unit, wherein the reverse position is settable to a position in which the second end portion remains in the cutter unit.

2. The cutting apparatus according to claim 1, wherein the reverse position is selectable from (a) a first position where the second end portion remains in the cutter unit and (b) a second position where the second end portion does not remain in the cutter unit.

3. The cutting apparatus according to claim 1, wherein the cutter unit reciprocates between a stand-by position near the first end portion and the reverse position near the second end portion, and the cutter unit cuts the sheet while moving to the reverse position from the stand-by position.

4. The cutting apparatus according to claim 3, wherein the stand-by position is set in accordance with a sensing result of the sensing unit.

5. The cutting apparatus according to claim 2, wherein the reverse position is set to be the first position or the second position, according to at least one of a width of the sheet and a kind of the sheet.

6. The cutting apparatus according to claim 1, wherein the sensing unit is mounted on a printing carriage for printing, the printing carriage being different from the cutter unit and being movable in a moving direction of the cutter unit.

7. The cutting apparatus according to claim 1, further comprising:

a detecting unit configured to detect a moving distance of the cutter unit, wherein the cutter unit moves on the basis of outputs of the detecting unit and the sensing unit.

8. The cutting apparatus according to claim 1, wherein the cutter unit includes:

a push-out portion that pushes out a cut piece of the sheet in a conveying direction of the sheet when the cutter blade cuts off the sheet to produce the cut piece.

9. The cutting apparatus according to claim 8, wherein the second end portion is positioned between a cutting portion of the cutter blade and the push-out portion when the cutter unit is positioned at the reverse position.

10. The cutting apparatus according to claim 8, wherein the cutter unit includes:

a first support surface configured to support the sheet, the first support surface being positioned on a downstream side, along the conveying direction, of a cutting portion of the cutter unit, and being formed at a position closer to a stand-by position than the cutting portion; and a second support surface configured to support the sheet, the second support surface being positioned on the downstream side, along the conveying direction, of the cutting portion, and being formed at a position closer to the reverse position than the cutting portion.

11. The cutting apparatus according to claim 10, wherein the first support surface is substantially parallel to a surface of the sheet, and the second support surface extends in the conveying direction.

12. The cutting apparatus according to claim 10, wherein the first support surface and the second support surface continue to each other.

13. The cutting apparatus according to claim 10, wherein extension planes of the respective first and second support surfaces cross each other at a position on the downstream side of the cutting portion along the conveying direction.

14. A printing apparatus comprising:

the cutting apparatus according to claim 1; and a printing unit configured to print an image on the sheet.

15. A printing apparatus comprising:

a conveying unit configured to convey a sheet in a conveying direction;

a printing head configured to print an image on the sheet;

a carriage configured to mount the printing head and to move in a direction crossing the conveying direction;

a cutter unit positioned at a downstream side of the printing head in the conveying direction and configured to move in a first direction crossing the conveying direction and a second direction opposite to the first direction when a cutting request is received, the first direction being a direction from a first end of the sheet toward a second end of the sheet, the cutter unit cutting the sheet when the cutter unit moves in the first direction;

a sensing unit mounted on the carriage and configured to sense a position of the second end of the sheet; and a determination unit configured to determine a stop position, according to the position of the second end of the sheet sensed by the sensing unit, at which the cutter unit stops movement in the first direction.

16. The printing apparatus according to claim 15, wherein the determination unit determines a reverse position at which the cutter unit stops movement in the first direction and reverses toward the second direction.

17. A printing apparatus comprising:

a conveying unit configured to convey a sheet in a conveying direction;

a printing head configured to print an image on the sheet;

a carriage configured to mount the printing head and to move in a direction crossing the conveying direction;

a cutter unit positioned at a downstream side of the printing head in the conveying direction and configured to move in a first direction crossing the conveying direction and a second direction opposite to the first direction when a cutting request is received, the first direction being a direction from a first end of the sheet toward a second end of the sheet, the cutter unit cutting the sheet in a case where the cutter unit moves in the first direction;

a sensing unit configured to sense a position of the second end of the sheet; and a determination unit configured to determine a stop position, according to the position of the second end of the sheet sensed by the sensing unit after the cutting request is received, at which the cutter unit stops the moving in the first direction.

18. The printing apparatus according to claim 17, wherein the determination unit determines a reverse position at which the cutter unit stops movement in the first direction and reverses toward the second direction.

19. The printing apparatus according to claim 17, wherein a cutting position of the cutter unit is positioned at a downstream side of the second end of the sheet in the first direction in a case where the cutter unit stops at the stop position.

20. The printing apparatus according to claim 15, wherein the stop position is settable to a position in which the second end portion remains in the cutter unit.

21. The printing apparatus according to claim 17, wherein the stop position is settable to a position in which the second end portion remains in the cutter unit.

* * * * *